US010639806B2

(12) United States Patent
Bozikis et al.

(10) Patent No.: US 10,639,806 B2
(45) Date of Patent: May 5, 2020

(54) SHAVING RAZORS AND SHAVING CARTRIDGES

(71) Applicant: BIC VIOLEX S.A., Anixi (GR)

(72) Inventors: Ioannis Bozikis, Koukaki-Athens (GR); Spiros Gratsias, Kypseli-Athens (GR); Christoforos-Athanasios Brellis, Neapoli-Athens (GR); Panagiotis Moustakas, Petroupoli-Athens (GR)

(73) Assignee: BIC-VIOLEX SA, Anixi (GR)

( * ) Notice: Subject to any disclaimer, the term of this patent is extended or adjusted under 35 U.S.C. 154(b) by 129 days.

(21) Appl. No.: 15/163,902

(22) Filed: May 25, 2016

(65) Prior Publication Data

US 2017/0151683 A1 Jun. 1, 2017

Related U.S. Application Data

(63) Continuation-in-part of application No. 14/964,745, filed on Dec. 10, 2015, now Pat. No. 9,539,734.

(60) Provisional application No. 62/271,571, filed on Dec. 28, 2015, provisional application No. 62/261,389, filed on Dec. 1, 2015.

(51) Int. Cl.
*B26B 21/22* (2006.01)
*B26B 21/40* (2006.01)

(52) U.S. Cl.
CPC ..... *B26B 21/227* (2013.01); *B26B 21/4012* (2013.01); *B26B 21/4087* (2013.01); *B26B 21/4075* (2013.01)

(58) Field of Classification Search
CPC ..... Y10T 224/44043; Y10T 224/4406; B26B 21/227; B26B 21/4012; B26B 21/16; B26B 21/165; B26B 21/02; B26B 21/06; B26B 21/222; B26B 21/4068; B26B 21/4075
USPC ..... 30/47–51, 62–68
See application file for complete search history.

(56) References Cited

U.S. PATENT DOCUMENTS

| | | | | |
|---|---|---|---|---|
| 4,868,983 | A * | 9/1989 | Francis | B26B 21/227 30/50 |
| 5,003,694 | A * | 4/1991 | Chen | B26B 21/4012 30/32 |
| 6,035,537 | A * | 3/2000 | Apprille, Jr. | B26B 21/227 30/346.5 |
| 8,286,354 | B2 * | 10/2012 | Walker, Jr. | B26B 21/225 30/32 |
| 2007/0028449 | A1 * | 2/2007 | King | B26B 21/521 30/49 |
| 2010/0077619 | A1 * | 4/2010 | Follo | B26B 21/225 30/50 |
| 2010/0175265 | A1 * | 7/2010 | Bozikis | B26B 21/227 30/50 |
| 2015/0090085 | A1 * | 4/2015 | Griffin | B26B 21/4018 83/13 |

* cited by examiner

*Primary Examiner* — Evan H MacFarlane
(74) *Attorney, Agent, or Firm* — Polsinelli PC

(57) ABSTRACT

A plurality of retainers operable to secure a plurality of blades within a housing of a shaving blade unit. The plurality of retainers extending along a pair of side edges of the housing, between a front edge of the housing and a rear edge of the housing.

7 Claims, 16 Drawing Sheets

SHAVING RAZORS AND SHAVING CARTRIDGES

CROSS REFERENCE TO RELATED APPLICATION

This application claims priority to and is a continuation-in-part of U.S. Provisional Application No. 62/271,571 filed Dec. 28, 2015, U.S. non provisional application Ser. No. 14/964,745 filed Dec. 10, 2015, and U.S. Provisional Application No. 62/261,389 filed Dec. 1, 2015, which are hereby incorporated herein by reference in their entireties for all purposes.

BACKGROUND

1. Field

The following description relates to shaving razors and shaving cartridges. A shaving razor or shaving cartridge may include one or more blades and one or more retainers for retaining elements of the shaving razor or shaving cartridge. For example, a pair of "C" shaped retainers extending along a pair of side edges of the shaving cartridge retains the blades in position within the housing.

2. Description of Related Art

Typically, a conventional razor head includes one or more razor blades secured to a razor head housing. A number of different securing mechanisms are typically used for securing razor blades. Such conventional mechanisms include clip retaining elements that wrap around the front and rear edges of a razor head housing and clip retaining elements that extend through one or more pairs of apertures adjacent to the front and rear ends of the housing.

For example, U.S. Pat. No. 6,035,537 describes a pair of clips that wrap around the front and rear ends of a razor housing for securing blades within the housing. U.S. Pat. No. 8,286,354 describes a razor head including two pairs of apertures formed in the body of the razor cartridge for receiving a pair of clips to retain the razor blades within the housing. U.S. Patent Application Publication No. 2015/0090085 describes a razor head including a pair of apertures and a pair of clips that extend through the pair of apertures on one end and wrap around the housing on the other end.

Several disadvantages are typically encountered in the manufacture of such conventional mechanisms. During the manufacturing process, clips may encounter buckling as a result of force that is applied during installation of the clips. As a result of bending force exerted on the clips, the clips have a tendency to buckle upwards. Consequently, blade exposures may be unstable throughout the razor cartridge and may vary significantly from intended blade exposure values. Also, during manufacturing process, clips may fail to be properly installed in a razor housing, which requires additional attention and labor to ensure that all of the clips are properly installed in the housing. Thus, the manufacture of such conventional mechanisms is inefficient, which results in production delays and increased production costs.

SUMMARY

The present inventive concept provides a retainer operable to secure a plurality of blades in a shaving unit that overcomes the aforementioned disadvantages of conventional mechanisms. The retainer of the present inventive concept includes upper, intermediate, and/or lower portions, or an upper portion and one or more legs that define one or more intermediate portions and/or one or more lower portions, such that the retainer is substantially "C" shaped. The retainer of the present inventive concept includes at least one protrusion on an inner surface of an upper portion thereof. The retainer of the present inventive concept includes at least one recess on an outer surface of an upper portion thereof. The retainer of the present inventive concept may include one or more, preferably a plurality, of bumps or ridges on an inner surface of an upper portion thereof. The retainer of the present inventive concept may include at least one aperture extending through a surface thereof and defined by one or more of upper, intermediate, and/or lower portions thereof.

In an embodiment of the present inventive concept, a retainer is operable to secure a plurality of blades in a shaving blade unit and may include an upper end portion and a lower end portion connected via an intermediate portion. The end portions may extend substantially parallel to each other. The intermediate portion may extend substantially perpendicular to the end portions. The upper end portion, the intermediate portion, and the lower end portion may collectively form a "C" shape.

The retainer may further include a surface pattern formed on the upper end portion. The surface pattern may include a plurality of ridges. Each of the plurality of ridges may extend downwardly and toward the lower end portion, and may define a blade-abutment surface. The plurality of ridges may extend from a planar surface of the upper end portion. The planar surface of the upper end portion may define a plurality of additional blade-abutment surfaces. The upper end portion may be operable to abuttingly engage a surface of each blade of a shaving blade unit at one of the blade-abutment surface of the plurality of ridges, and/or one of the additional blade-abutment surfaces of the planar surface. Each of the plurality of additional blade-abutment surfaces and each of the blade-abutment surface of the plurality of ridges may be operable to cooperatively secure one blade of a shaving blade unit. Each of the plurality of ridges may include a tip that is offset to a one side of each of the plurality of ridges.

The retainer may further include at least one protrusion formed between the plurality of ridges of the upper end portion and the intermediate portion. The protrusion may extend downwardly and toward the lower end portion. The protrusion may extend from a planar surface of the upper end portion to a tip, and may be defined by a backstop surface on a side of the protrusion and extending substantially perpendicular to the planar surface of the upper end portion, and/or an angled surface on another side of the protrusion extending between the tip of the protrusion and the planar surface of the upper end portion. The retainer may further include side surfaces defined by coplanar edges of the end portions and/or the intermediate portion. The protrusion may extend entirely between the side surfaces of the retainer, may extend partially between the side surfaces of the retainer, and/or may include a plurality of protrusions that extend between the side surfaces of the retainer and are spaced from the end portions and/or not spaced from the end portions.

The retainer may further include at least one recess formed on the upper end portion and extending inwardly and toward the lower end portion. The recess may extend entirely between the side surfaces of the retainer and along the upper end portion, may extend partially between the side surfaces of the retainer and along the upper end portion, and/or may include a plurality of recesses that extend between the side surfaces of the retainer and are spaced from the end portions and/or not spaced from the end portions.

In an embodiment of the present inventive concept, a retainer is operable to secure a plurality of blades in a shaving blade unit and may include an upper end portion with a plurality of edges. Each of the edges may define a side surface of the upper end portion. The retainer may further include a leg depending from one of the plurality of edges to form a lower end portion such that a part of the side surface of the one of the plurality of edges may be concealed by the leg, and/or another part of the side surface of the one of the plurality of edges may be exposed by the leg. The leg may be curved such that a tip of the lower end portion extends toward the upper end portion to partially enclose a cavity defined by the leg and the upper end portion.

In an embodiment of the present inventive concept, a retainer is operable to secure a plurality of blades in a shaving blade unit and may include an upper end portion with a plurality of edges. Each of the edges may define a side surface of the upper end portion. The retainer may further include a plurality of legs depending from one of the plurality of edges of the upper end portion. Each of the plurality of legs may have a lower end portion and/or may be connected to the upper end portion such that a part of the side surface of the one of the plurality of edges is concealed by each of the plurality of legs, and/or another part of the side surface of the one of the plurality of edges is exposed by each of the plurality of legs. Each of the plurality of legs may include a side surface that is coplanar to one of the side surfaces of the upper end portion. Each of the plurality of legs may be curved such that a tip of each of the lower end portions extends toward the upper end portion to partially enclose a cavity defined by the plurality of legs and/or the upper end portion.

In an embodiment of the present inventive concept, a retainer is operable to secure a plurality of blades in a shaving blade unit and may include an upper end portion with a plurality of edges. Each of the edges may define a side surface of the upper end portion. The retainer may further include a plurality of legs extending from the upper end portion such that each of the plurality of legs may conceal a part of the side surface of the one of the plurality of edges, and/or another part of the side surface of the one of the plurality of edges may be exposed by the plurality of legs. The retainer may further include a lower end portion connected to the upper end portion via at least one of the plurality of legs. The retainer may include an aperture defined by the plurality of legs, the lower end portion, and/or the upper end portion. The upper end portion that defines the aperture may be the another part of the side surface of the one of the plurality of edges of the upper end portion.

The foregoing is intended to be illustrative and is not meant in a limiting sense. Many features of the embodiments may be employed with or without reference to other features of any of the embodiments. Additional aspects, advantages, and/or utilities of the present inventive concept will be set forth in part in the description that follows and, in part, will be apparent from the description, or may be learned by practice of the present inventive concept.

BRIEF DESCRIPTION OF THE DRAWINGS

The foregoing summary, as well as the following detailed description, will be better understood when read in conjunction with the appended drawings. For the purpose of illustration, there is shown in the drawings certain embodiments of the present disclosure. It should be understood, however, that the present inventive concept is not limited to the precise embodiments and features shown. The accompanying drawings, which are incorporated in and constitute a part of this specification, illustrate an implementation of apparatuses consistent with the present inventive concept and, together with the description, serve to explain advantages and principles consistent with the present inventive concept.

DETAILED DESCRIPTION

Figure 1A:
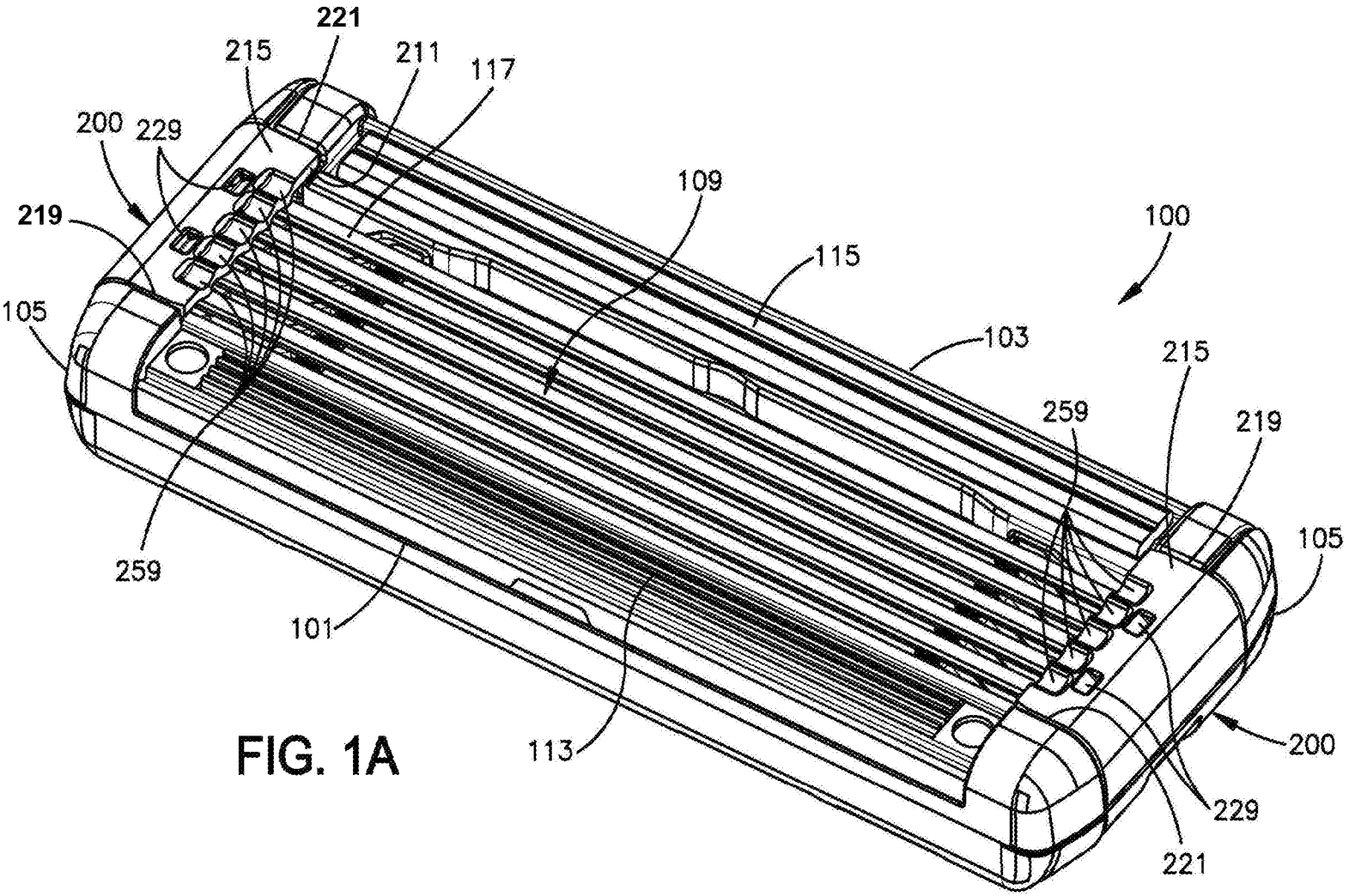
FIG. 1A is a diagram illustrating a perspective view of a shaving cartridge with retainers operable to secure blades to the cartridge.
Figure 1B:
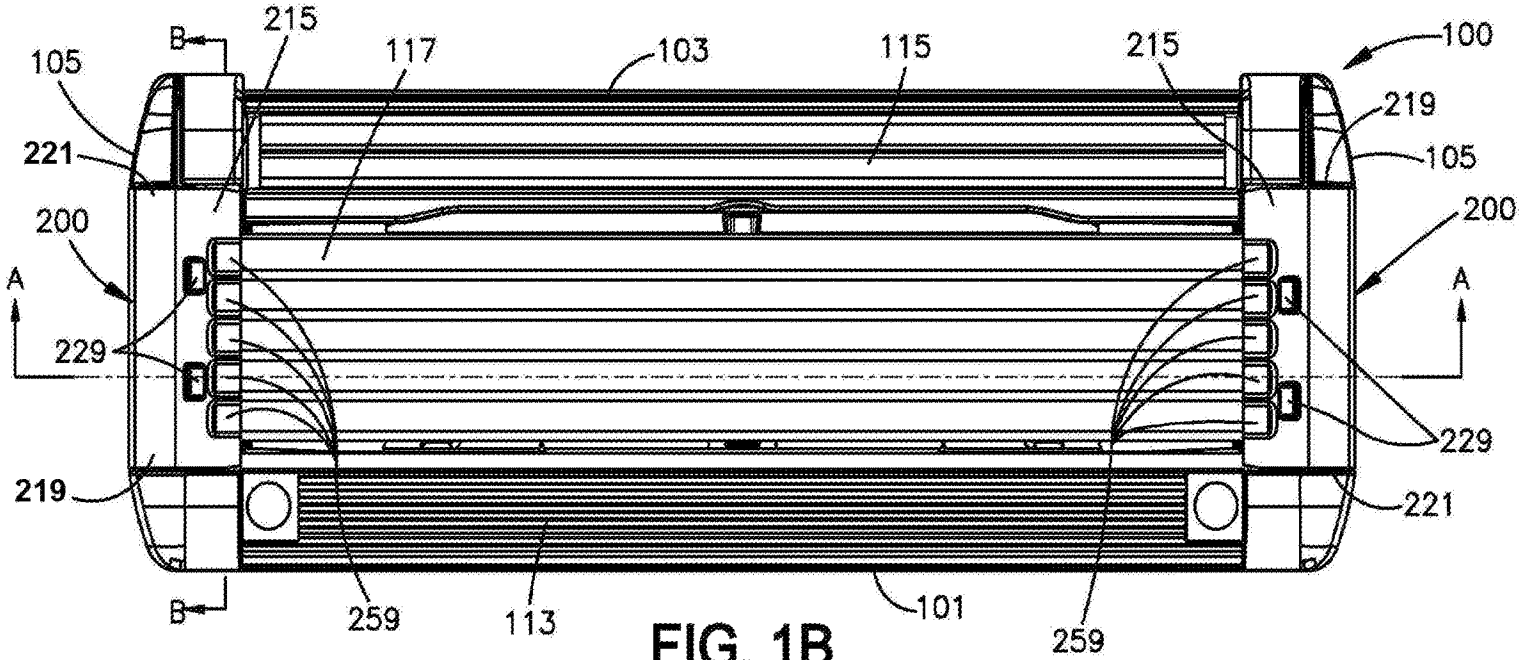
FIG. 1B is a diagram illustrating a top view of the shaving cartridge including the retainers.
Figure 1C:
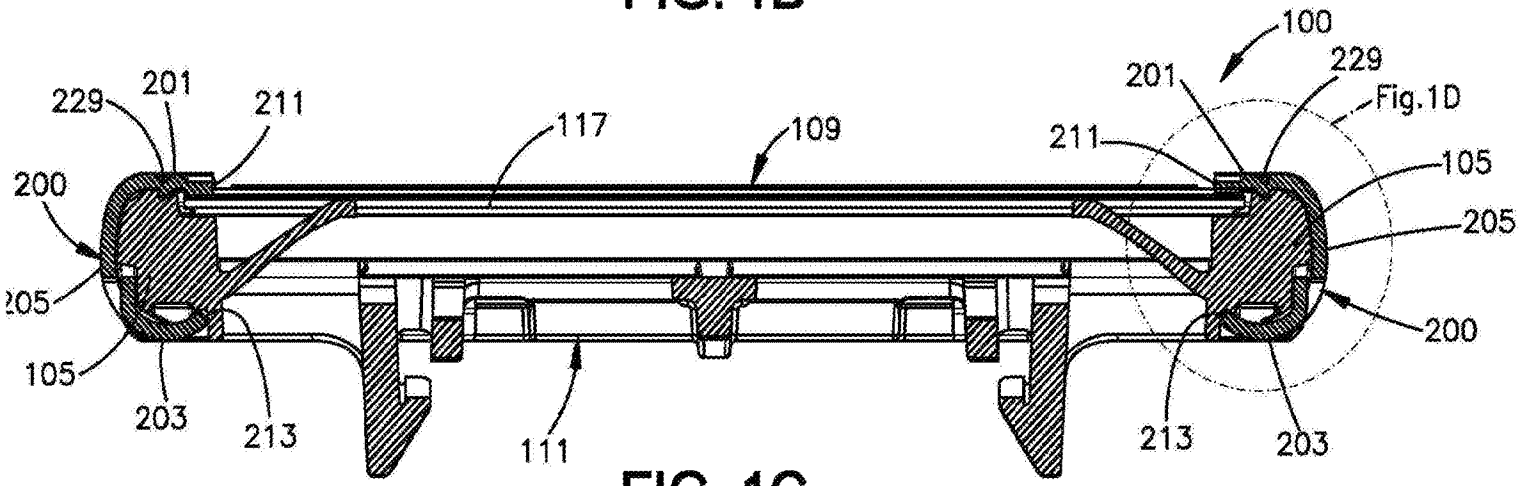
FIG. 1C is a diagram illustrating a cross-sectional view of the shaving cartridge including the retainers along the line A-A shown in FIG. 1B.
Figure 1D:
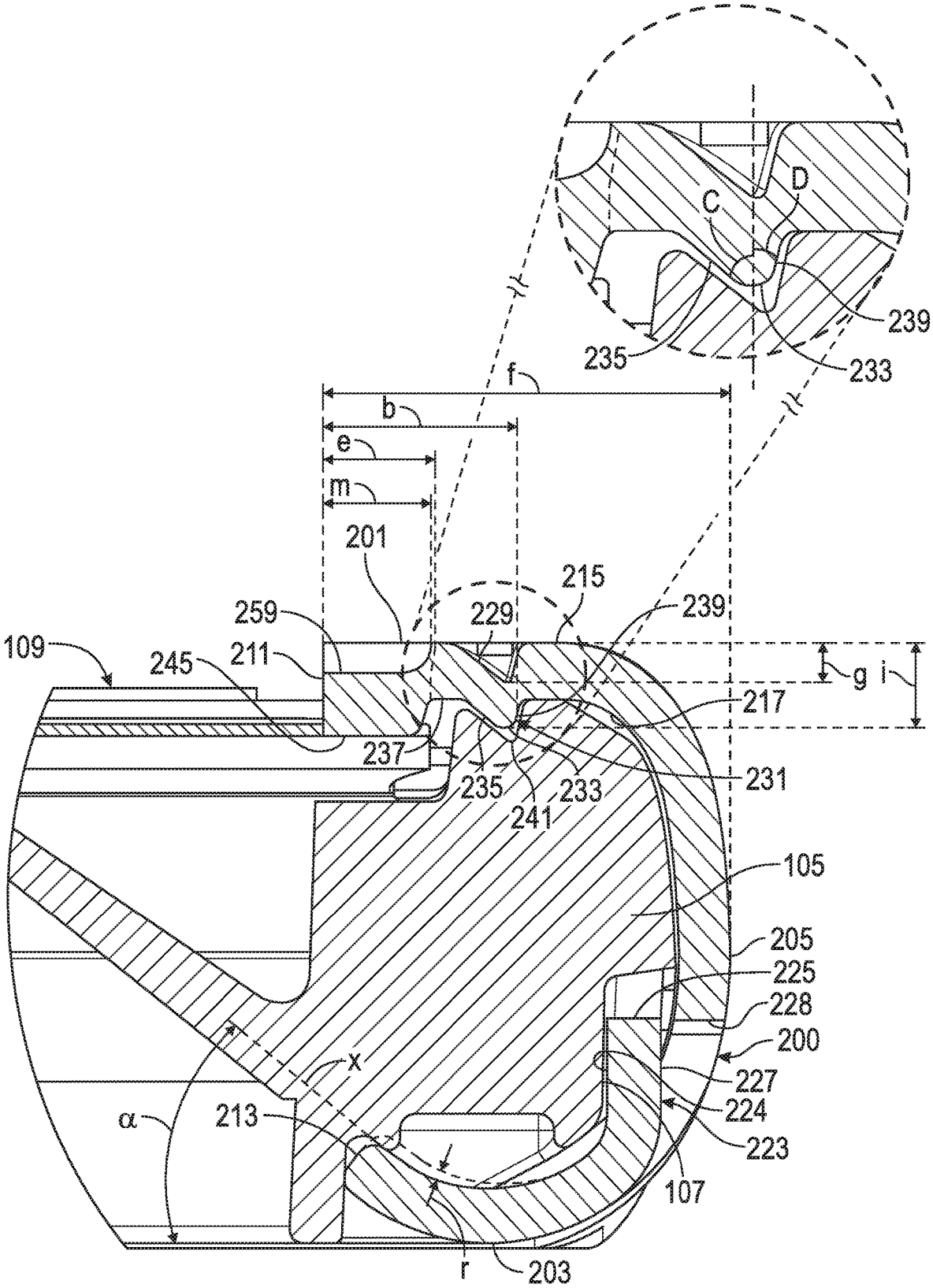
FIG. 1D is a diagram illustrating a magnified cross-sectional view of the shaving cartridge and one of the retainers in region 1D shown in FIG. 1C.
Figure 1E:
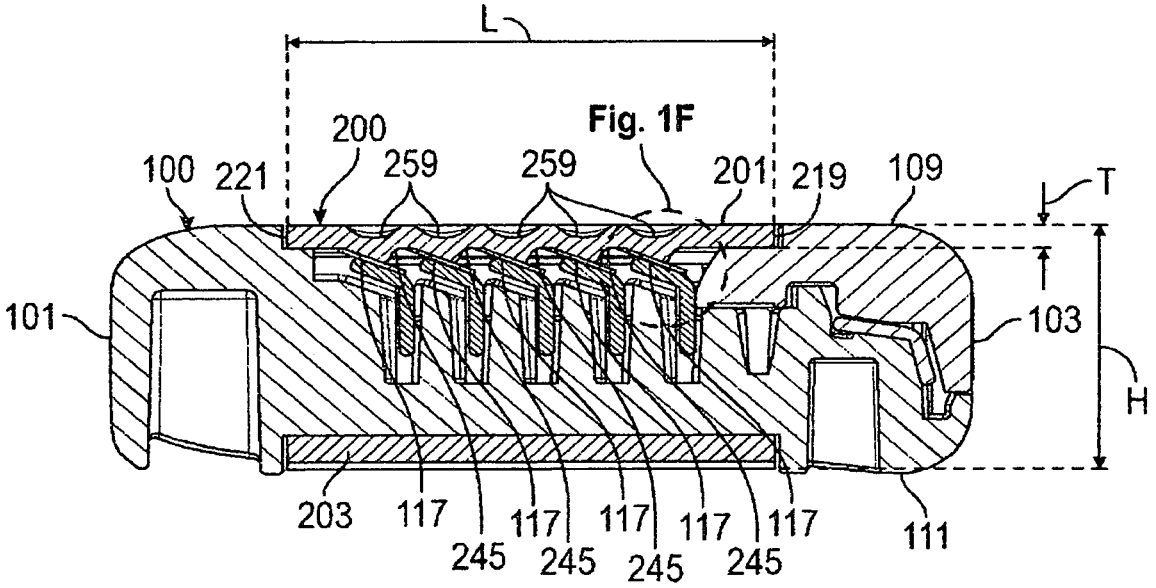
FIG. 1E is a diagram illustrating a cross-sectional view of the shaving cartridge including one of the retainers along the line B-B shown in FIG. 1B.
Figure 1F:
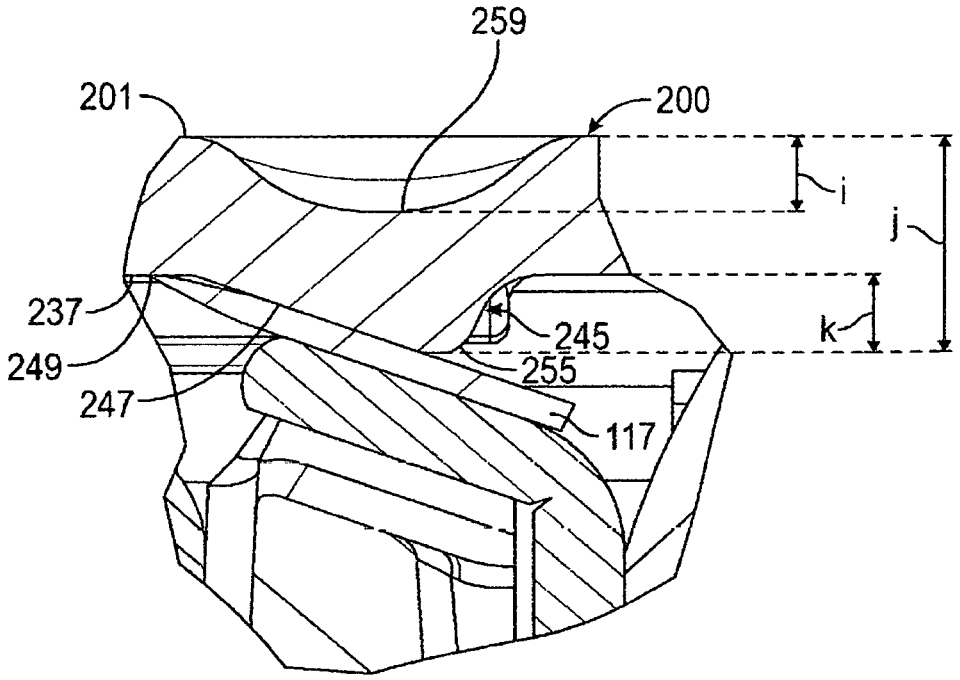
FIG. 1F is a diagram illustrating a magnified cross-sectional view of the shaving cartridge and retainer in the region 1F shown in FIG. 1E.

It is to be understood that the present inventive concept is not limited in its application to the details of construction and to the embodiments of the components set forth in the following description or illustrated in the drawings. The figures and written description are provided to teach any person skilled in the art to make and use the inventions for which patent protection is sought. The present inventive concept is capable of other embodiments and of being practiced and carried out in various ways. Persons of skill in the art will appreciate that the development of an actual commercial embodiment incorporating aspects of the present inventive concept will require numerous implementations—specific decisions to achieve the developer's ultimate goal for the commercial embodiment. While these efforts may be complex and time-consuming, these efforts nevertheless would be a routine undertaking for those of skill in the art of having the benefit of this disclosure.

I. Terminology

The phraseology and terminology employed herein are for the purpose of description and should not be regarded as limiting. For example, the use of a singular term, such as, "a" is not intended as limiting of the number of items. Also, the use of relational terms such as, but not limited to, "top," "bottom," "left," "right," "upper," "lower," "down," "up," "side," are used in the description for clarity in specific reference to the figures and are not intended to limit the scope of the present inventive concept or the appended claims. Further, it should be understood that any one of the features of the present inventive concept may be used separately or in combination with other features. Other systems, methods, features, and advantages of the present inventive concept will be or become apparent to one with skill in the art upon examination of the figures and the detailed description. It is intended that all such additional systems, methods, features, and advantages be included within this description, be within the scope of the present inventive concept, and be protected by the accompanying claims.

Further, any term of degree such as, but not limited to, "substantially," as used in the description and the appended claims, should be understood to include an exact or a comparable but not exact configuration. For example, "substantially C" shaped means having an exact "C" shape or a comparable but not exact "C" shape. Also, "a substantially planar surface" means having an exact planar surface or a comparable, but not exact planar surface. Similarly, the terms "about" or "approximately," as used in the description and the appended claims, should be understood to include the recited values or a value that is three times greater or one third of the recited values. For example, about 3 millimeters includes all values from 1 millimeter to 9 millimeters, and approximately 50 degrees includes all values from 16.6 degrees to 150 degrees.

Further, as the present inventive concept is susceptible to embodiments of many different forms, it is intended that the present disclosure be considered as an example of the principles of the present inventive concept and not intended to limit the present inventive concept to the specific embodiments shown and described. Any one of the features of the present inventive concept may be used separately or in combination with any other feature. References to terms "embodiment," "embodiments," and/or the like in the description mean that the feature and/or features being referred to are included in at least one aspect of the description. Separate references to terms "embodiment," "embodiments," and/or the like in the description do not necessarily refer to the same embodiment and are also not mutually exclusive unless so stated and/or except as will be readily apparent to those skilled in the art from the description. For example, a feature, structure, process, step, action, or the like described in one embodiment may also be included in other embodiments, but is not necessarily included. Thus, the present inventive concept may include a variety of combinations and/or integrations of the embodiments described herein. Additionally, all aspects of the present disclosure, as described herein, are not essential for its practice. Likewise, other systems, methods, features, and advantages of the present inventive concept will be or become apparent to one with skill in the art upon examination of the figures and the description. It is intended that all such additional systems, methods, features, and advantages be included within this description, be within the scope of the present inventive concept, and be encompassed by the claims.

Lastly, the terms "or" and "and/or," as used herein, are to be interpreted as inclusive or meaning any one or any combination. Therefore, "A, B or C" or "A, B and/or C" mean "any of the following: A, B, C; A and B; A and C; B and C; A, B and C." An exception to this definition will occur only when a combination of elements, functions, steps or acts are in some way inherently mutually exclusive.

II. General Architecture

Turning to FIGS. 1A-1F and 12, a shaving cartridge 100 secured to a handle 10 is illustrated, which includes a housing having a front edge 101, a rear edge 103, a side edge 105 with aperture 107 on both sides of the housing, a top surface 109, and a bottom surface 111. The pair of side edges 105 extends between the front edge 101 of the housing and the rear edge 103 of the housing. The apertures 107 of the side edges 105 are spaced from the edges 101, 103 and substantially centered therebetween. The shaving cartridge 100 includes a guard bar 113 adjacent to the front edge 101 of the housing and a cap 115 adjacent to the rear edge 103 of the housing. A plurality of blades 117 is positioned between the guard bar 113 and the cap 115, and retained in position within the housing using a plurality of retainers 200 that are substantially "C" shaped. As will be apparent to one of skill in the art, it is foreseen that one or more of the plurality of retainers 200 may be otherwise shaped and yet have the same or similar functionality as discussed herein without deviating from the scope of the present inventive concept. For instance, one or more of the plurality of retainers 200 may be substantially "L" shaped, "M" shaped, "T" shaped, "U" shaped, "V" shaped, "W" shaped, "Y"

shaped "7" shaped and/or the like without deviating from the scope of the present inventive concept. In the preferred embodiment, the shaving cartridge 100 includes five blades 117 that are retained in position within the housing using the retainers 200, but it is foreseen that any number of blades, e.g., one to ten, may be used without deviating from the scope of the present inventive concept.

The retainers 200 are spaced apart and mounted on the pair of side edges 105 of the housing and on either side of the blades 117. The retainers 200, having a length L, extends partially along the side edges 105 at a distance of about 8.5 millimeters, and include a top or upper end portion 201 extending above the top surface 109 of the housing and over the blades 117 to retain the position of the blades 117 within the housing. It is foreseen that the retainers 200 may be modified to extend along a shorter or a longer portion of the side edges 105, without deviating from the scope of the present inventive concept. For example, one or both of the retainers 200 may be modified to extend along an entire length, a shorter portion, or a longer portion of the side edges 105, without deviating from the scope of the present inventive concept. It is foreseen that the retainers 200 may be used, with or without modifications to length, width, and/or height, to retain other components of the razor head 100 within the housing in addition to the blades 117, e.g., the guard bar 113, the cap 115, a lubrication strip, and/or a plurality of fins, without deviating from the scope of the present inventive concept. It is foreseen that any number of the retainers 200, e.g., a single retainer or four retainers, may be used to secure and position the blades 117 or other components of the shaver cartridge 100 within the housing, without deviating from the scope of the present inventive concept.

Figure 2B:
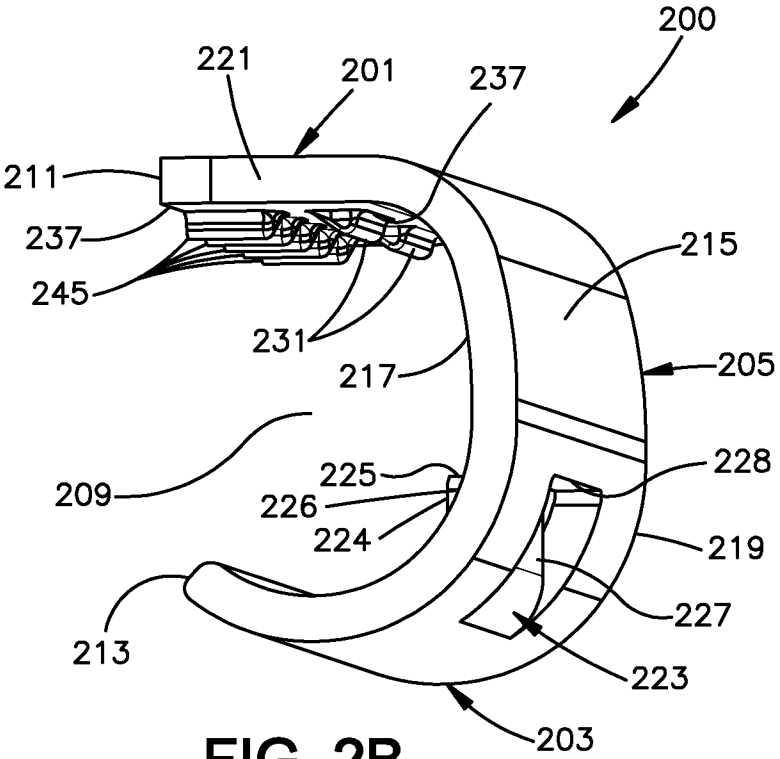
FIG. 2B is a diagram illustrating a bottom, rear perspective view of the one of the retainers shown in FIG. 2A.
Figure 2A:
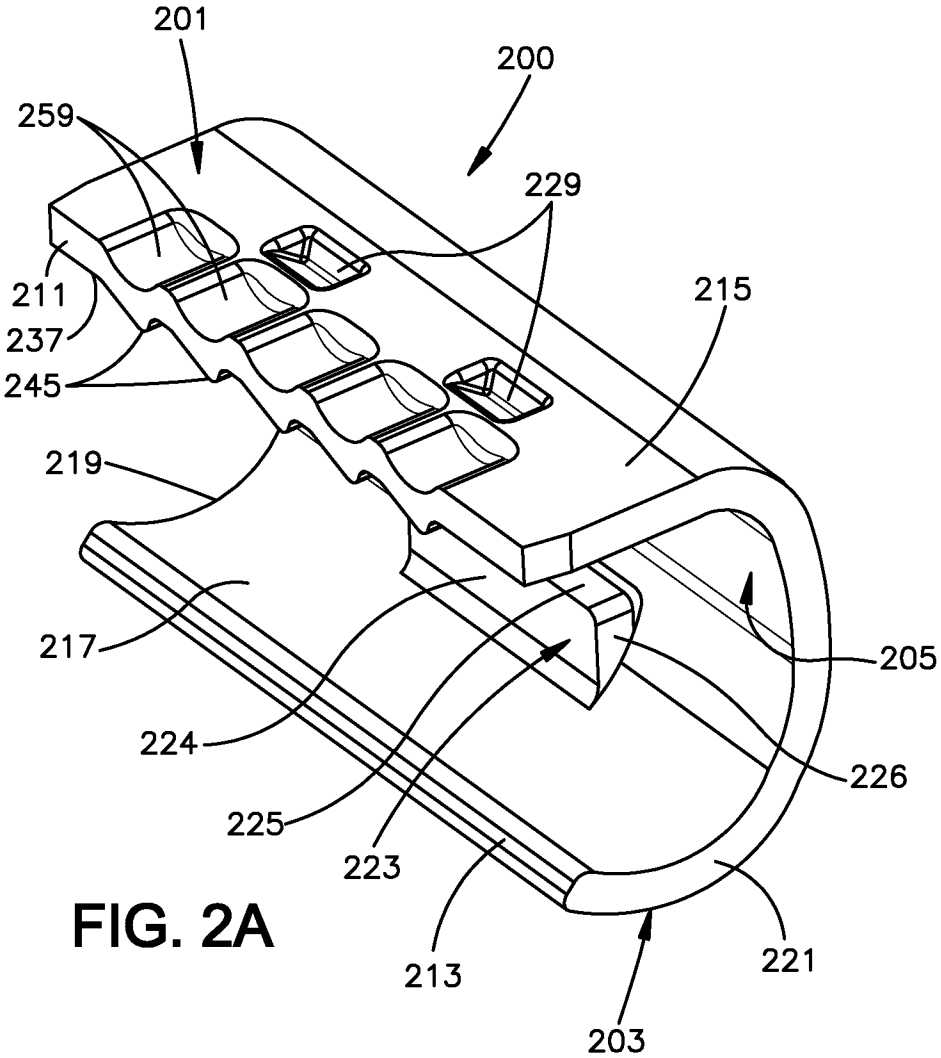
FIG. 2A is a diagram illustrating a top, front perspective view of the one of the retainers shown in FIG. 1A.

The retainer 200 includes the upper end portion 201, a bottom or lower end portion 203, and a middle or intermediate portion 205, which connects the upper end portion 201 to the lower end portion 203, as illustrated in FIGS. 2A-2B. The upper end portion 201, the lower end portion 203, and the intermediate portion 205, collectively, define a cavity 209, which is operable to securely receive a portion of the side edge 105 therein. The retainer 200 includes a first face, or tip 211, on the upper end portion 201 and a second face, or tip 213, on the lower end portion 203, with each of the tips 211, 213 generally facing toward the blades 117. The first tip 211 is substantially planar and the second tip 213 is substantially rounded. The second tip 213 includes a curvature defined by a plurality of radii inclusive of, about, and/or between 0.1 millimeters and 0.25 millimeters, and preferably inclusive of, about, and/or between 0.15 millimeters and 0.2 millimeters. It is foreseen that either or both of the tips 211, 213 may be rounded, planar, or a combination thereof, without deviating from the scope of the present inventive concept. An outer surface 215 of the retainer 200 extends entirely between the tips 211, 213 and along the portions 201, 203, 205. On an opposite side of the retainer 200, an inner surface 217 extends entirely between the tips 211, 213 and along the portions 201, 203, 205 to directly abut, and substantially surround, the side edge 105 of the housing of the cartridge 100. The retainer 200 includes a rear edge 219 that is most adjacent to the cap 115 and a front edge 221 that is most adjacent to the guard bar 113. It is foreseen that the retainer 200 could be designed so that the rear edge 219 is most adjacent to the guard bar 113 and the front edge 221 is most adjacent to the cap 115 without deviating from the scope of the present inventive concept. In the exemplary embodiment, the edges 219, 221 are coplanar side surfaces of the portions 201, 203, 205.

The upper end portion 201 of the retainer 200 is substantially planar and operable to abut each of the blades 117 so that each of the blades 117 is secured within the housing of the shaving cartridge 100. The lower end portion 203 and the intermediate portion 205 are substantially rounded and, in coordination with the upper end portion 201, operable to substantially surround a portion the side edge 105. The curvature of the lower end portion 203 is defined by a plurality of radii inclusive of, about, and/or between 2 millimeters and 3 millimeters, and preferably inclusive of, about, and/or between 2.20 millimeters and 2.55 millimeters. The curvature of the intermediate portion 205 is defined by a plurality of radii inclusive of, about, and/or between 1 millimeter and 6 millimeters, and preferably inclusive of, about, and/or between 1.5 millimeters and 5.9 millimeters. In this manner, the upper end portion 201 of the retainer 200 extends along an uppermost portion of the side edge 105 and the lower end portion 203 of the retainer 200 is curved around a lowermost portion of the side edge 105 upon installation of the retainer 200 onto the side edge 105. It is foreseen that the lower end portion 203 and/or the intermediate portion 205 may include one or more straight portions throughout its length and/or may include a single radius of curvature, without deviating from the scope of the present inventive concept.

The retainer 200 includes a positioner 223 formed in the intermediate portion 205. On the inner surface 217 of the retainer 200, the positioner 223 includes a protruding portion 224 that extends outwardly relative to the inner surface 217 to define top and side abutment surfaces 225, 226. The protruding portion 224 of the positioner 223 is operable to extend into and nest within the aperture 107 on the side edge 105, with the top and side abutment surfaces 225, 226 abutting adjacent walls of the aperture 107. In this manner, the protruding portion 224 of the positioner 223 is operable to further secure the retainer 200 to the shaving cartridge 100. On the outer surface 215 of the retainer 200, the positioner 223 includes an indented portion 227 that extends inwardly relative to the outer surface 215 to expose a downwardly-facing fastening surface 228. The indented portion 227 of the positioner 223 and the surface 228 cooperatively provide gripping surfaces operable to facilitate fastening of the retainer 200 to the aperture 107 on the side edge 105.

The retainer 200 includes a plurality of recesses 229 and a plurality of protrusions 231, which are formed on the surfaces 215, 217 of the retainer 200, respectively, and cooperatively operable to further secure the retainer 200 to the shaving cartridge 100. Each of the recesses 229 is formed on the outer surface 215 of the upper end portion 201 of the retainer 200, and has a generally uniform semicircular shape with a radius of about 0.12 millimeters and the depth g of about 0.25 millimeters. Each of the recesses 229 is operable to improve planar stiffness of the upper end portion 201. Each of the protrusions 231 is formed on the inner surface 217 of the upper end portion 201 of the retainer 200, and has a triangular shape. On a side of each of the protrusions 231, an angled surface 235 extends between a tip 233 of each of the protrusions 231 and a planar portion 237 of the inner surface 217 of the upper end portion 201. The angled surface 235 extends at the angle c of about 55 degrees relative to a vertical line passing through the tip 233 of each of the protrusions 231. On another side of each of the protrusions 231, a backstop surface 239 extends between the tip 233 of the each of the protrusions 231 and the inner surface 217. The backstop surface 239 extends at the angled of about 5 degrees relative to the vertical line passing through the tip 233 of each of the protrusions 231. The depth i of each of the protrusions 231 from the uppermost part of the upper end portion 201 is about 0.75 millimeters. Each of the protrusions 231 is operable to be received by a corresponding surface 241 on the side edge 105. The planar stiffness of the retainer 200 that is improved by the recesses 229 enhances an ability of the plurality of protrusions 231 to securely anchor the retainer 200 to the housing of the cartridge 100.

The retainer 200 includes a plurality of ridges 245 extending downwardly from the planar portion 237 of the upper end portion 201 and toward the lower end portion 203. The length j of the first tip 211, which includes the plurality of ridges 245, is about 0.8 millimeters. The depth k of the plurality of ridges 245 from the planar portion 237 of the upper end portion 201 to a tip 255 of the plurality of ridges 245 is about 0.3 millimeters. The plurality of ridges 245 extends along the upper end portion 201, i.e., from the first tip 211 to a point along the planar portion 237 that is adjacent to the plurality of protrusions 231. In this manner, the plurality of ridges 245 is spaced from the plurality of protrusions 231. The distance e from the first tip 211 to the point along the planar portion 237 where the plurality of ridges 245 terminate is about 5.2 millimeters.

In the exemplary embodiment, the tip 255 of each of the plurality of ridges 245 is offset to one side of each of the plurality of ridges 245 to accommodate a planar blade-abutment surface 247. As such, each of the plurality of ridges 245 includes a curvature defined by a plurality of radii of about 0.15 millimeters. Each of the planar blade-abutment surfaces 247 is operable abuttingly engage one of the blades 117, in coordination with another blade-abutment surface 249 of the planar portion 237 of the upper end portion 201. Each of the blade-abutment surfaces 247 abuts approximately 30% of a region of each of the blades 117. Each of the blade-abutment surfaces 249 abuts less than 10% of another region of each of the blades 117, e.g., at a single point on each of the blades 117. In this manner, each of the blade-abutment surfaces 247, 249 are generally aligned with and cooperatively abut, position, and retain each of the blades 117 in the shaving cartridge 100. In the exemplary embodiment, the number of the plurality of ridges 245 of the retainer 200 is equal to the number of blades 117 of the shaving cartridge 100, i.e., the retainer 200 includes five of the plurality of ridges 245 and five of the blades 117. It is foreseen, however, that the retainer 200 may include any number of ridges or the retainer 200 may be provided without ridges, without deviating from the scope of the present inventive concept. For example, the retainer 200 may have between none and ten ridges.

On an opposite side of the upper end portion 201 relative to the plurality of ridges 245 is a plurality of depressions 259 in the outer surface 215. Each of the plurality of depressions 259 preferably has a generally uniform semi-circular shape, with a radius of about 0.6 millimeters and a depth 1 from the uppermost part of the upper end portion 201 to the lowermost part of the plurality of depressions 259 of about 0.275 millimeters. Similar to the plurality of ridges 245, the plurality of depressions 259 extend along the upper end portion 201, i.e., from the first tip 211 to a point along the upper end portion 201 that is adjacent to the plurality of recesses 229. In this manner, the plurality of depressions 259 is spaced from the plurality of recesses 229. The distance m from the first tip 211 to the point along the upper end portion 201 where the plurality of depressions 259 terminates is about 1.0 millimeter. Similar to the plurality of recesses 229, the plurality of depressions 259 is operable to improve planar stiffness of the upper end portion 201, which improves an ability of the blade-abutment surfaces 247, 249 to securely abut, position, and retain each of the blades 117 in the shaving cartridge 100.

The retainer 200 has a thickness that may range throughout the length of the retainer 200, with a greatest thickness T being approximately 0.5 millimeters. The height H of the retainer 200, from the uppermost part of the upper end portion 201 to the lowermost part of the lower end portion 203, is about 5.3 millimeters. The distance b, from the innermost part of the first tip 211 that is closest to the center of the housing to the tip 233 of each of the protrusions 231, is about 1.9 millimeters, but it is foreseen that the distance b may range from about 1.0 millimeters to about 3.0 millimeters without deviating from the scope of the present inventive concept. The distance f, from an innermost part of the first tip 211 that is closest to a center of the housing to an outermost part of the retainer 200 that is farthest from the center of the housing, is about 4.0 millimeters, but it is foreseen that the distance f may range from about 3.0 millimeters to about 5.0 millimeters. The angle a, between the horizontal line that is tangent to a lowermost point of the lower end portion 203 and the line x that is tangent to an innermost point on the inner surface of the lower end portion 203, is approximately 22 degrees, when the retainer 200 is detached from the shaving cartridge 100 and in an original or unloaded configuration. In the preferred embodiment, the angle a is a positive angle that can range from about 0 to about 60 degrees. The value of the angle a directly affects an ability of the retainer 200 to securely engage a specific head design, e.g., the side surface 105. For instance, a decrease in the angle a results in a tighter engagement therebetween and an increase in the angle a results in a looser engagement therebetween. Additionally, via the resilient nature of the material of the retainer 200, the retainer 200 is designed so that the angle a is decreased when the retainer 200 is securely attached to the shaving cartridge 100 or in a loaded configuration between about 1 and 15 degrees. Thus, to secure the retainer 200 to the side surface 105, the retainer 200 is flexibly expanded from the unloaded configuration and beyond the loaded configuration, positioned so that the side surface 105 is within the cavity 209, and released. Upon release of the retainer 200, the resilient nature of the material of the retainer 200 causes the retainer 200 to be biased toward the unloaded configuration. The side surfaces 105 prevent the retainer 200 from completely returning to the unloaded configuration and causes the lower end portion 203 of the retainer 200 to be displaced a distance r from the unloaded configuration and maintained in the loaded configuration. In the exemplary embodiment, the distance r is about 0.1 millimeter to about 0.3 millimeters and preferably about 0.11 millimeters. In this manner, once the retainer 200 is installed in the shaving cartridge 100, with the plurality of ridges 245 abutting the blades 117, the resilient nature of the material of the retainer 200 and the displacement causes the plurality of ridges 245 to apply a downward pressure on the blades 117, such that the blades 117 are biased into the shaving cartridge 100. The pressure applied by the plurality of ridges 245 advantageously maintains the position of the blades 117, thereby maintaining blade exposure of each of the blades 117, with respect to a contact plane, and maintaining shaving angle values of the shaving cartridge 100. The contact plane may refer to a plane that is formed on the surface of the guard bar 113 and the cap 115.

It should be appreciated by one of ordinary skill in the art that the dimensions and shapes of the retainer 200 are only an example of the preferred embodiment, a number of other dimensions and/or shapes may be used for the retainer 200, as well as the plurality of protrusions 231, the plurality of recesses 229, the plurality of ridges 245, and/or the plurality of depressions 259. Such other shapes include, but are not limited to, triangular, oblong, square, rectangular, circular, semi-circular, elliptical, and/or other related shapes. It is foreseen that such other retainer designs may include same and/or similar components to the retainer 200, so as to be easily substituted in place of the retainer 200.

Figure 3B:
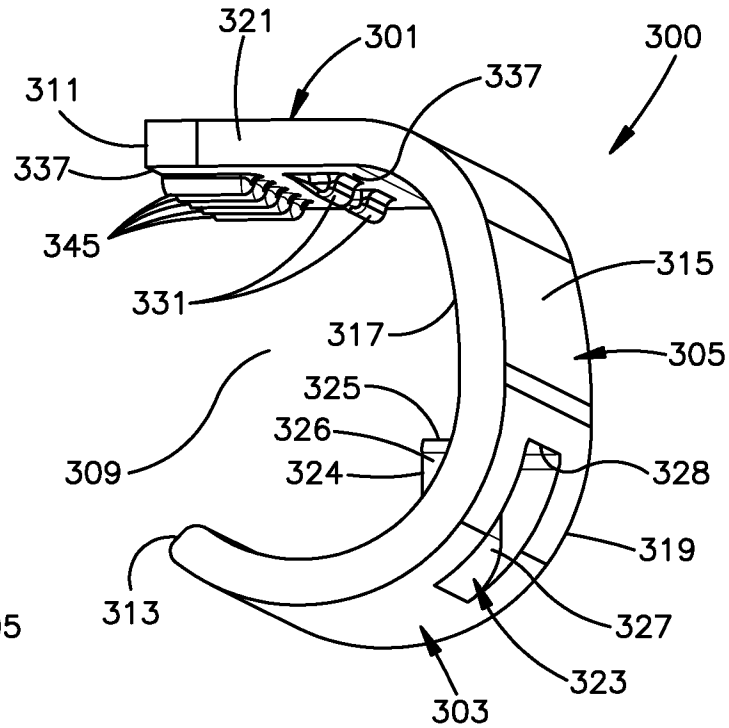
FIG. 3B is a diagram illustrating a bottom, rear perspective view of the retainer shown in FIG. 3A.
Figure 3A:
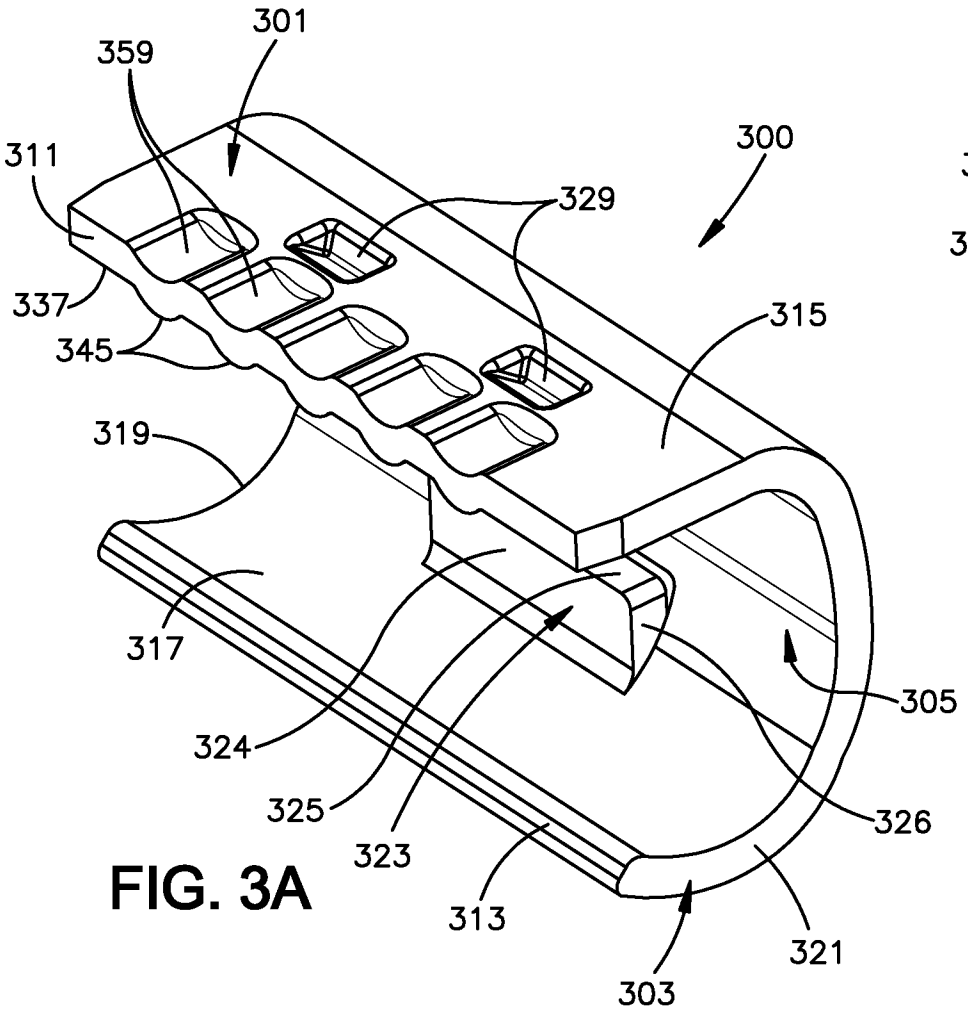
FIG. 3A is a diagram illustrating a top, front perspective view of another embodiment of a retainer of the present inventive concept.

For instance, in another embodiment of the present inventive concept, a retainer 300 is provided, as illustrated by FIGS. 3A and 3B. Similar to the retainer 200, the retainer 300 includes an upper end portion 301, a bottom or lower end portion 303, and a middle or intermediate portion 305, which connects the upper end portion 301 to the lower end portion 303. The upper end portion 301, the lower end portion 303, and the intermediate portion 305 collectively define a cavity 309, which is operable to securely receive the portion of the side edge 105 therein. The retainer 300 includes a first face, or tip 311, on the upper end portion 301 and a second face, or tip 313, on the lower end portion 303, with each of the tips 311, 313 generally facing toward the blades 117, when the retainer 300 is mounted to the cartridge 100. The first tip 311 is substantially planar and the second tip 313 is substantially rounded, with a curvature defined by a plurality of radii inclusive of, about, and/or between 0.1 millimeters and 0.25 millimeters, and preferably inclusive of, about, and/or between 0.15 millimeters and 0.2 millimeters. It is foreseen that either or both of the tips 311, 313 may be rounded, planar, or a combination thereof, without deviating from the scope of the present inventive concept. An outer surface 315 of the retainer 300 extends entirely between the tips 311, 313 and along the portions 301, 303, 305. On an opposite side of the retainer 300, an inner surface 317 extends entirely between the tips 311, 313 and along the portions 301, 303, 305 to directly abut, and substantially surround a portion the side edge 105 of the housing of the cartridge 100, when the retainer 300 is mounted to the cartridge 100. The retainer 300 includes a rear edge 319 that is most adjacent to the cap 115 and a front edge 321 that is most adjacent to the guard bar 113, when the retainer 300 is mounted to the cartridge 100. It is foreseen that the retainer 300 could be designed so that the rear edge 319 is most adjacent to the guard bar 113 and the front edge 321 is most adjacent to the cap 115 without deviating from the scope of the present inventive concept. In this embodiment, the edges 319, 321 of the retainer 300 are coplanar side surfaces of the portions 301, 303, 305.

The retainer 300 includes a positioner 323 formed in the intermediate portion 305. On the inner surface 317 of the retainer 300, the positioner 323 includes a protruding portion 324 that extends outwardly relative to the inner surface 317 and defines top and side abutment surfaces 325, 326. The protruding portion 324 of the positioner 323 is operable to extend into and nest within the aperture 107 on the side edge 105, with the top and side abutment surfaces 325, 326 abutting adjacent walls of the aperture 107, when the retainer 300 is mounted to the cartridge 100. In this manner, the protruding portion 324 of the positioner 323 is operable to further secure the retainer 300 to the shaving cartridge 100. On the outer surface 315 of the retainer 300, the positioner 323 includes an indented portion 327 that extends inwardly relative to the outer surface 315 to expose a downwardly-facing fastening surface 328. The indented portion 327 of the positioner 323 and the surface 328 cooperatively provide gripping surfaces operable to facilitate fastening of the retainer 300 to the aperture 107 on the side edge 105.

Figure 3C:
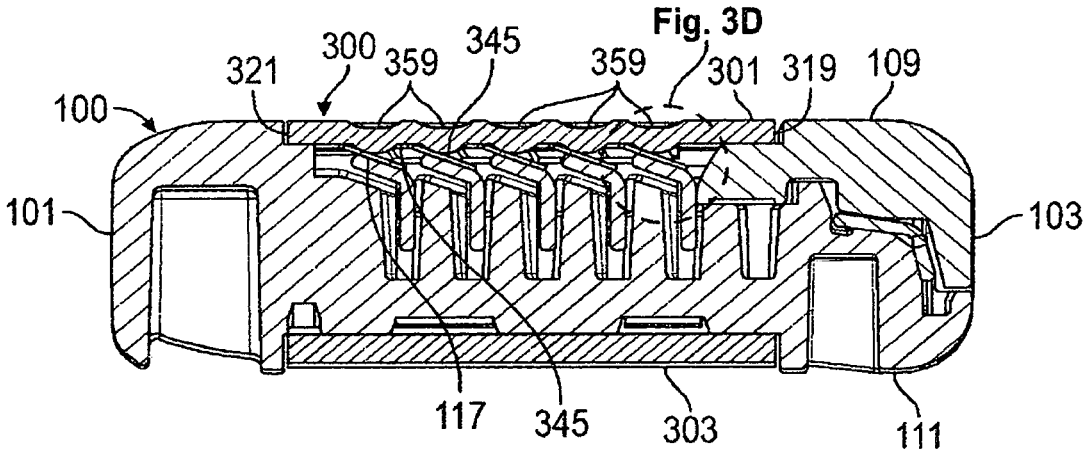
FIG. 3C is a diagram illustrating a cross-sectional view of the shaving cartridge along the line B-B shown in FIG. 1B, but with the retainer shown in FIG. 1B replaced with the retainer shown in FIG. 3B.
Figure 3D:
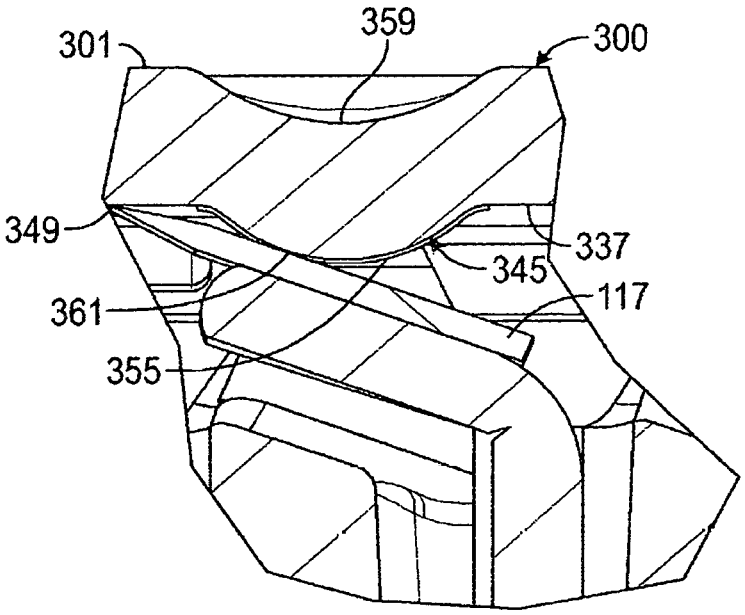
FIG. 3D is a diagram illustrating a magnified cross-sectional view of the shaving cartridge and retainer in the region 3D shown in FIG. 3C.

Similar to the retainer 200, the retainer 300 includes a plurality of recesses 329 and a plurality of protrusions 331, which are formed on the surfaces 315, 317 of the retainer 300, respectively, and cooperatively operable to further secure the retainer 300 to the shaving cartridge 100. Similar to the retainer 200, the upper end portion 301 of the retainer 300 also includes a surface pattern that includes a plurality of ridges 345. The plurality of ridges 345 extend downwardly from a planar portion 337 of the upper end portion 301 and toward the lower end portion 303. Each of the plurality of ridges 345 includes a tip 355 that is centered thereon, rather than offset as the tips 255 of the retainer 200. FIGS. 3C and 3D depict the retainer 300 mounted to the cartridge 100 in place of the retainer 200 illustrated in FIGS. 1E and 1F. In this embodiment, a blade-abutment surface 361 of each of the plurality of ridges 345 is curved, and the plurality of ridges 345 has a generally uniform curvature with a radius of about 0.5 millimeters. Each of the blade-abutment surfaces 361 abut one of the blades 117 in coordination with the another blade-abutment surface 349 of the planar portion 337 of the upper end portion 301. In this manner, each of the blade-abutment surfaces 349, 361 cooperatively abut, position, and retain each of the blades 117 in the shaving cartridge 100. On an opposite side of the upper end portion 301 relative to the plurality of ridges 345, the surface pattern of the upper end portion 301 includes a plurality of depressions 359 in the outer surface 315 of the upper end portion 301. Similar to the plurality of ridges 345, the plurality of depressions 359 extend along the upper end portion 301, i.e., from the first tip 311 to a point along the upper end portion 301 that is adjacent to the plurality of recesses 329. The plurality of depressions 359 is operable to improve planar stiffness of the upper end portion 301, in coordination with the plurality of recesses 329, which improves an ability of the blade-abutment surfaces 349, 361 to securely abut, position, and retain each of the blades 117 in the shaving cartridge 100. The surface pattern formed in the upper end portion 301 of the retainer 300 results in the tip 311 having a curvature as illustrated in FIG. 3C.

Figure 4B:
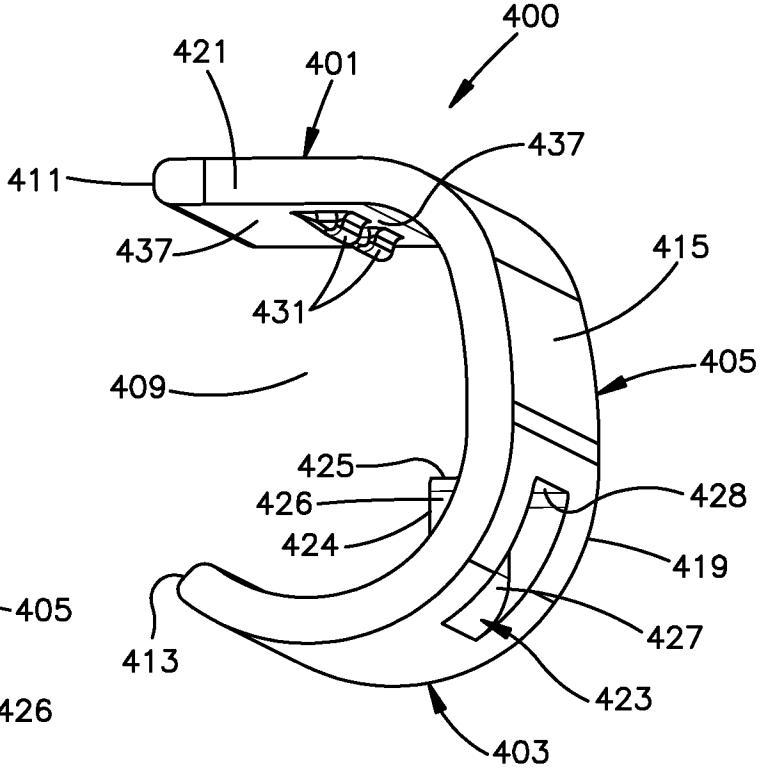
FIG. 4B is a diagram illustrating a bottom, rear perspective view of the retainer shown in FIG. 4A.
Figure 4A:
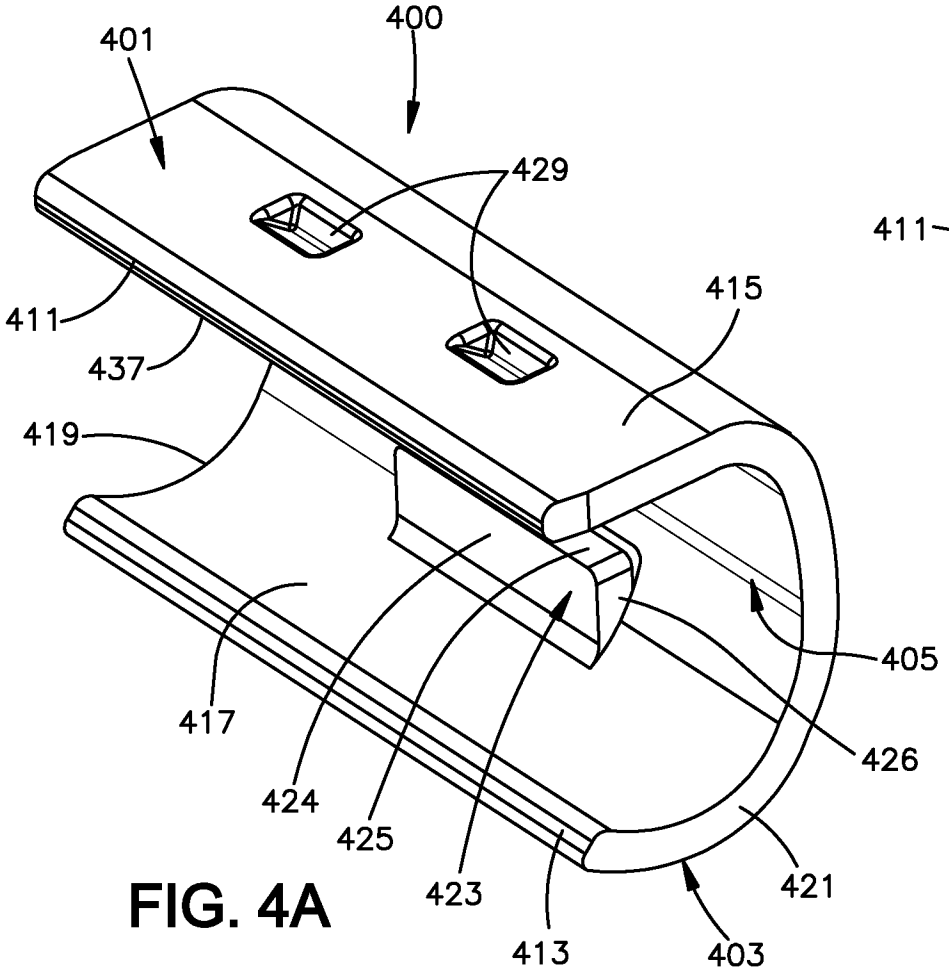
FIG. 4A is a diagram illustrating a top, front perspective view of another embodiment of the retainers shown in FIG. 1A.

Turning to FIGS. 4A and 4B, another embodiment of the present inventive concept is illustrated with a retainer 400. Similar to the retainers 200, 300, the retainer 400 includes an upper end portion 401, a bottom or lower end portion 403, and a middle or intermediate portion 405, which connects the upper end portion 401 to the lower end portion 403. The upper end portion 401, the lower end portion 403, and the intermediate portion 405 collectively define a cavity 409, which is operable to securely receive the portion of the side edge 105 therein. The retainer 400 includes a first face, or tip 411, on the upper end portion 401 and a second face, or tip 413, on the lower end portion 403, with each of the tips 411, 413 generally facing toward the blades 117, when the retainer 400 is mounted to the cartridge 100. The tips 411, 413 are substantially rounded, each with a curvature defined by a plurality of radii inclusive of, about, and/or between 0.1 millimeters and 0.25 millimeters, and preferably inclusive of, about, and/or between 0.15 millimeters and 0.2 millimeters. It is foreseen that either or both of the tips 411, 413 may be rounded, planar, or a combination thereof, without deviating from the scope of the present inventive concept. An outer surface 415 of the retainer 400 extends entirely between the tips 411, 413 and along the portions 401, 403, 405. On an opposite side of the retainer 400, an inner surface 417 extends entirely between the tips 411, 413 and along the portions 401, 403, 405 to directly abut and substantially surround a portion of the side edge 105 of the housing of the cartridge 100, when the retainer 400 is mounted to the cartridge 100. The retainer 400 includes a rear edge 419 that is adjacent to the cap 115 and a front edge 421 that is adjacent to the guard bar 113 when the retainer 400 is mounted to the cartridge 100. It is foreseen that the retainer 400 could be designed so that the rear edge 419 is most adjacent to the guard bar 113 and the front edge 421 is most adjacent to the cap 115 without deviating from the scope of the present inventive concept. In this embodiment, the edges 419, 421 of the retainer 400 are coplanar side surfaces of the portions 401, 403, 405.

Similar to the retainers 200, 300, the retainer 400 includes a positioner 423 formed in the intermediate portion 405. On the inner surface 417 of the retainer 400, the positioner 423 includes a protruding portion 424 that extends outwardly and defines top and side abutment surfaces 425, 426. The protruding portion 424 of the positioner 423 is operable to extend into and nest within the aperture 107 on the side edge 105, with the top and side abutment surfaces 425, 426 abutting adjacent walls of the aperture 107, when the retainer 400 is mounted to the cartridge 100. In this manner, the protruding portion 424 of the positioner 423 is operable to further secure the retainer 400 to the shaving cartridge 100. On the outer surface 415 of the retainer 400, the positioner 423 includes an indented portion 427 that extends inwardly to expose a downwardly-facing fastening surface 428. The indented portion 427 of the positioner 423 and the surface 428 cooperatively provide gripping surfaces operable to facilitate fastening of the retainer 400 to the aperture 107 on the side edge 105.

Similar to the retainers 200, 300, the retainer 400 includes a plurality of recesses 429 and a plurality of protrusions 431, which are formed on the surfaces 415, 417 of the retainer 400, respectively, and cooperatively operable to further secure the retainer 400 to the shaving cartridge 100. Similar to the retainers 200, 300, the upper end portion 401 of the retainer 400 also includes a surface pattern, but does not include any ridges or depressions. Rather, the surface pattern of the upper end portion 401 of the retainer 400 is substantially planar and has a planar portion 437. In this manner, the planar portion 437 is operable to abut, position, and retain each of the blades 117 in the shaving cartridge 100 when the retainer 400 is mounted to the cartridge 100. The surface pattern formed in the upper end surface 401 of the retainer 400 results in the tip 411 having substantially planar upper and lower surfaces.

Figure 5B:
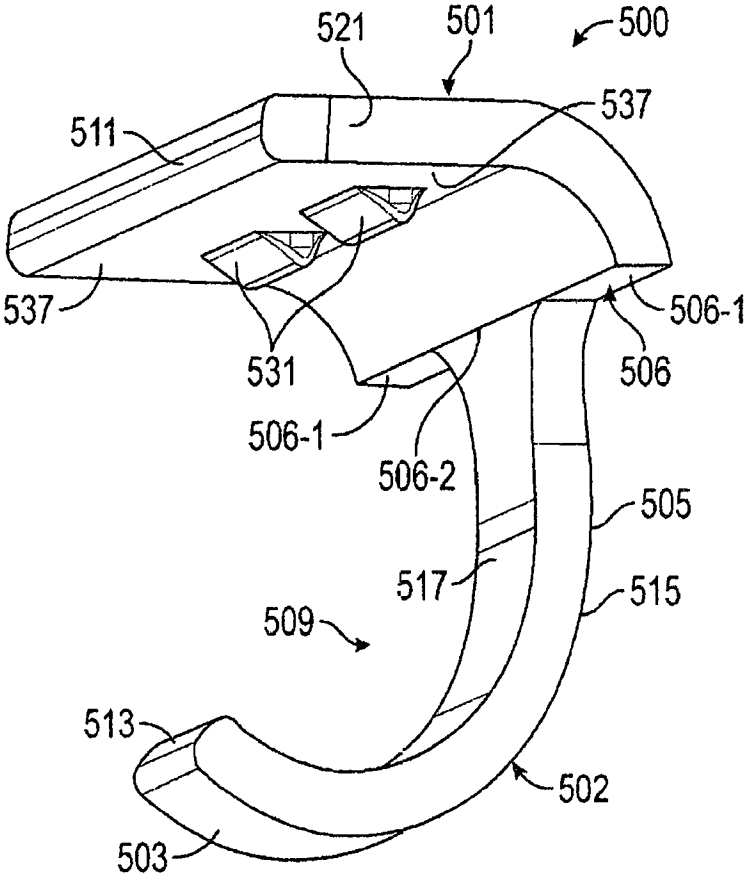
FIG. 5B is a diagram illustrating a bottom, rear perspective view of the retainer shown in FIG. 5A.
Figure 5A:
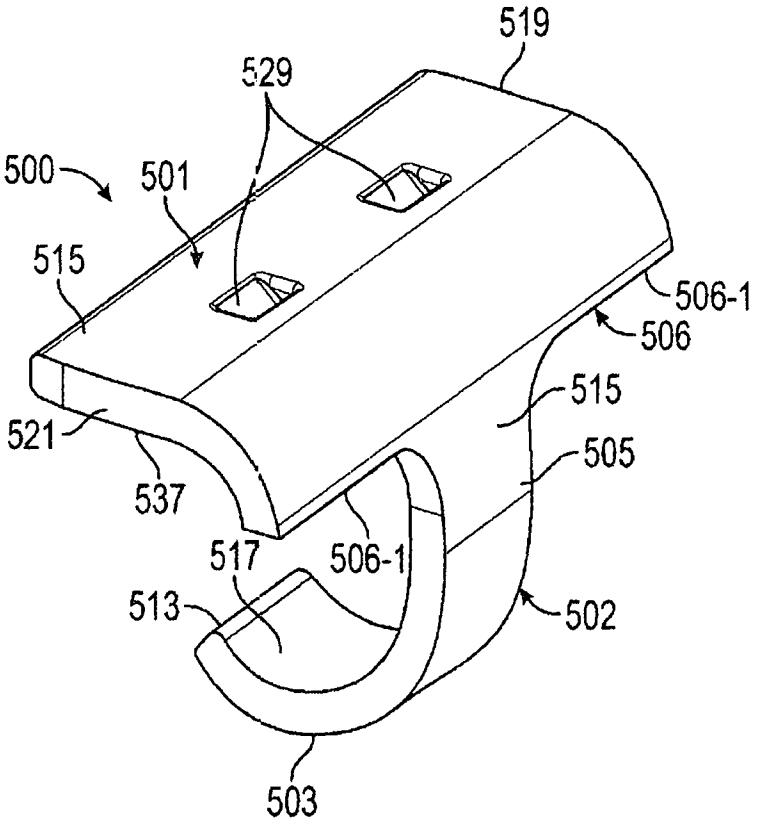
FIG. 5A is a diagram illustrating a top, front perspective view of another embodiment of the retainers shown in FIG. 1A.

Turning to FIGS. 5A and 5B, another embodiment of the present inventive concept is illustrated with a retainer 500. Similar to the retainers 200, 300, 400, the retainer 500 includes an upper end portion 501, but includes a leg 502 having a bottom or lower end portion 503, and a middle or intermediate portion 505. The leg 502 depends from only a portion of an edge 506 of the upper end portion 501. In this manner, the leg 502 causes an exposed portion 506-1 of the edge 506 to be exposed by the leg 502, and a concealed portion 506-2 of the edge 506 to be concealed by the leg 502. In the exemplary embodiment, the leg 502 is integrally formed with the upper end portion 501. It is foreseen, however, that the leg 502 could be manufactured separately from the upper end portion 501 and secured thereto during manufacturing of the retainer 500, e.g., via welding, glue, or other attachment means, without deviating from the scope of the present inventive concept.

The intermediate portion 505 connects the upper end portion 501 to the lower end portion 503. The upper end portion 501, the lower end portion 503, and the intermediate portion 505 collectively define a cavity 509, which is operable to securely receive the portion of the side edge 105 therein. The retainer 500 includes a first face, or tip 511, on the upper end portion 501 and a second face, or tip 513, on the lower end portion 503, with each of the tips 511, 513 generally facing toward the blades 117, when the retainer 500 is mounted to the cartridge 100. The tips 511, 513 are substantially rounded, each with a curvature defined by a plurality of radii inclusive of, about, and/or between 0.1 millimeters and 0.25 millimeters, and preferably inclusive of, about, and/or between 0.15 millimeters and 0.2 millimeters. It is foreseen that either or both of the tips 511, 513 may be rounded, planar, or a combination thereof without deviating from the scope of the present inventive concept. An outer surface 515 of the retainer 500 extends entirely between the tips 511, 513 and along the portions 501, 503, 505. On an opposite side of the retainer 500, an inner surface 517 extends entirely between the tips 511, 513 and along the portions 501, 503, 505 to directly abut and substantially surround a portion of the side edge 105 of the housing of the cartridge 100 when the retainer 500 is mounted to the cartridge 100. The upper end surface 501 of the retainer 500 includes a rear edge 519 that is adjacent to the cap 115 and a front edge 521 that is adjacent to the guard bar 113 when the retainer 500 is mounted to the cartridge 100. It is foreseen that the retainer 500 could be designed so that the rear edge 519 is most adjacent to the guard bar 113 and the front edge 521 is most adjacent to the cap 115 without deviating from the scope of the present inventive concept. In this embodiment, edges 519, 521 of the upper end surface 501 of the retainer 500 are not coplanar to side surfaces of the portions 503, 505.

Also, in this embodiment, unlike the retainers 200, 300, 400, the retainer 500 does not include a positioner. Similar to the retainers 200, 300, 400, the retainer 500 includes a plurality of recesses 529 and a plurality of protrusions 531, which are formed on the surfaces 515, 517 of the retainer 500, respectively, and cooperatively operable to further secure the retainer 500 to the shaving cartridge 100 when the retainer 500 is mounted to the cartridge 100. Similar to the retainer 400, the upper end portion 501 of the retainer 500 also includes a surface pattern without any ridges or depressions. The surface pattern of the upper end portion 501 of the retainer 500 is substantially planar and has a planar portion 537. In this manner, the planar portion 537 is operable to abut, position, and retain each of the blades 117 in the shaving cartridge 100 when the retainer 500 is mounted to the cartridge 100. The surface pattern formed in the upper end surface 501 of the retainer 500 results in the tip 511 having substantially planar upper and lower surfaces. Relative to the retainers 200, 300, 400, the reduced sizes of the intermediate portion 505 and the lower end portion 503 of the leg 502 advantageously provide increased resilience of the leg 502, which facilitates assembly of the shaving cartridge 100 using the retainer 500. Likewise, the reduced sizes of the intermediate portion 505 and the lower end portion 503 advantageously provide increased exposure of, and access to, the pair of side edges 105 while reducing material consumption and manufacturing costs. For instance, it is foreseen that the increased exposure of the side edges 105 could allow a user to view a component such as a visual usage indicator. It is also foreseen that at least a portion of the retainer 500 could be made of a transparent material to allow a user to view a component such as a visual usage indicator without deviating from the scope of the present inventive concept. The component may be positioned on one or both of the side edges 105 and adjacent to the blades 117. The component may be operable to communicate a status of the cartridge 100 to the user based on one or more other components of the cartridge 100, e.g., whether the cartridge 100 is new and functional, used and partially functional, and/or depleted and non-functional.

Figure 6B:
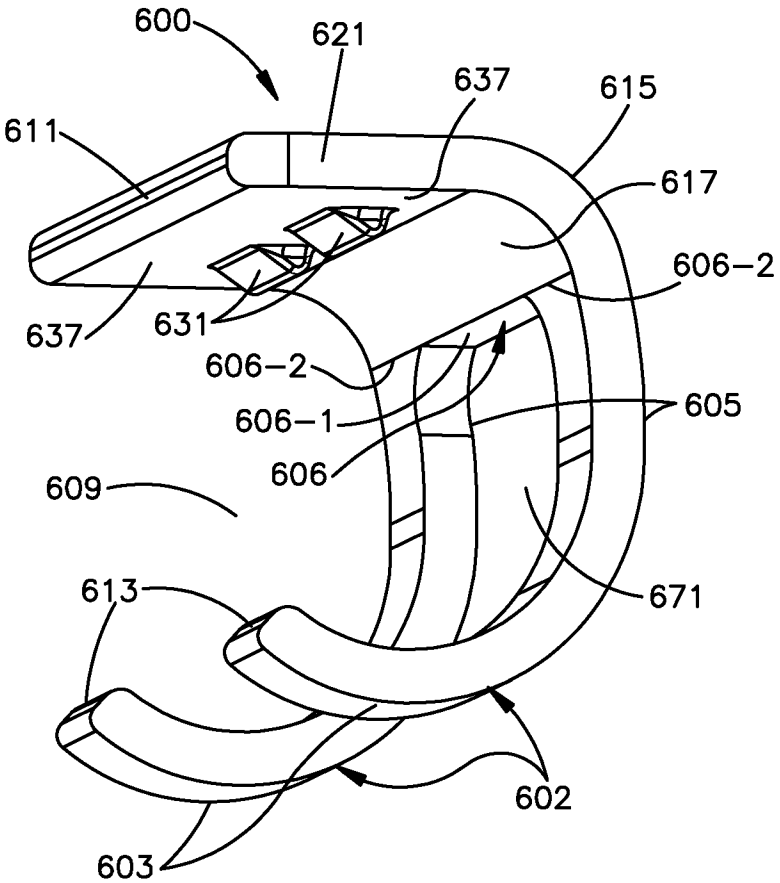
FIG. 6B is a diagram illustrating a bottom, rear perspective view of the retainer shown in FIG. 6A.
Figure 6A:
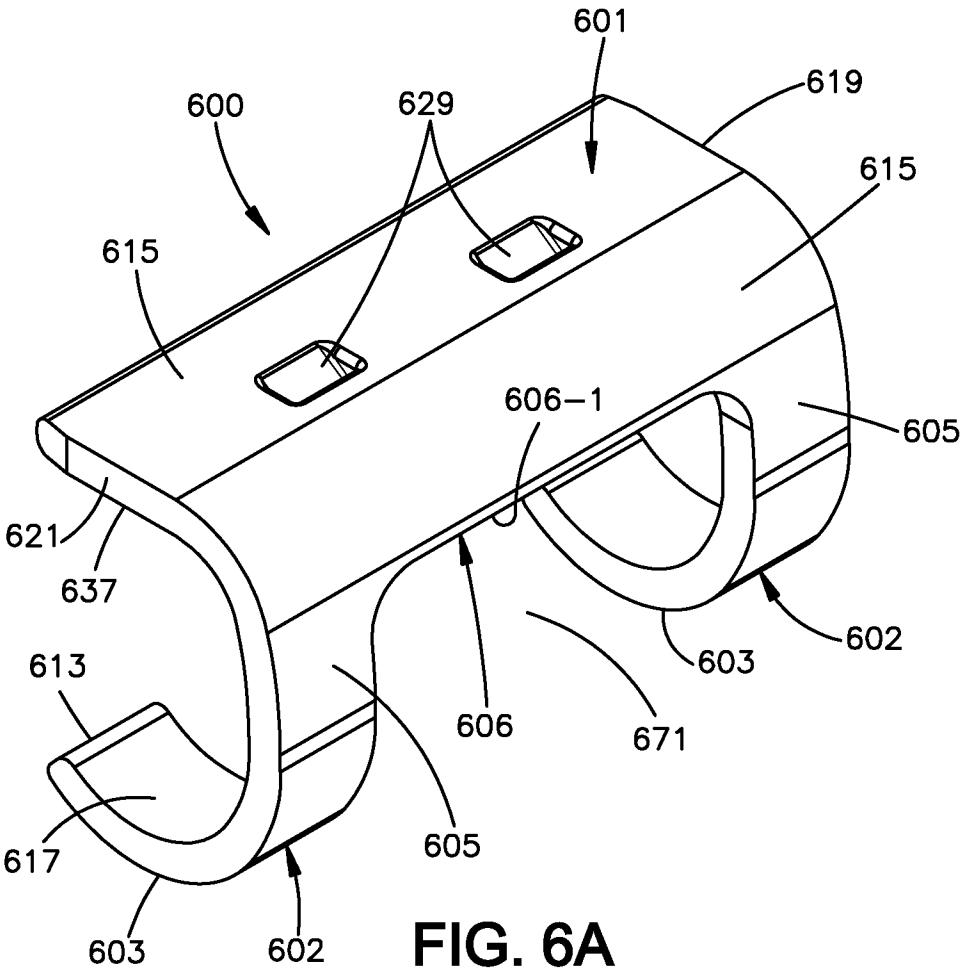
FIG. 6A is a diagram illustrating a top, front perspective view of another embodiment of the retainers shown in FIG. 1A.

Turning to FIGS. 6A and 6B, another embodiment of the present inventive concept is illustrated with a retainer 600. Similar to the retainer 500, the retainer 600 includes an upper end portion 601, but includes a plurality of legs 602, each having a bottom or lower end portion 603, and a middle or intermediate portion 605. Each of the legs 602 depend from only a portion of an edge 606 of the upper end portion 601. In this manner, the legs 602 cause an exposed portion 606-1 of the edge 606 to be exposed by the legs 602, and a concealed portion 606-2 of the edge 606 to be concealed by the legs 602. In the exemplary embodiment, each of the legs 602 is integrally formed with the upper end portion 601. It is foreseen, however, that one or both of the legs 602 could be manufactured separately from the upper end portion 601 and secured thereto during manufacturing of the retainer 600, e.g., via welding, glue, or other attachment means, without deviating from the scope of the present inventive concept.

Each of the intermediate portions 605 connects the upper end portion 601 to the lower end portions 603. The upper end portion 601, the lower end portions 603, and the intermediate portions 605 collectively define a cavity 609, which is operable to securely receive the portion of the side edge 105 therein. The retainer 600 includes a first face, or tip 611, on the upper end portion 601 and a second face, or tip 613, on each of the lower end portion 603 with each of the tips 611, 613 generally facing toward the blades 117 when the retainer 600 is mounted to the cartridge 100. The tips 611, 613 are substantially rounded, each with a curvature defined by a plurality of radii inclusive of, about, and/or between 0.1 millimeters and 0.25 millimeters, and preferably inclusive of, about, and/or between 0.15 millimeters and 0.2 millimeters. It is foreseen that either or both of the tips 611, 613 may be rounded, planar, or a combination thereof without deviating from the scope of the present inventive concept. An outer surface 615 of the retainer 600 extends entirely between the tips 611, 613 and along the portions 601, 603, 605. On an opposite side of the retainer 600, an inner surface 617 extends entirely between the tips 611, 613 and along the portions 601, 603, 605 to directly abut and substantially surround a portion of the side edge 105 of the housing of the cartridge 100 when the retainer 600 is mounted to the cartridge 100. The upper end surface 601 of the retainer 600 includes a rear edge 619 that is adjacent to the cap 115 and a front edge 621 that is adjacent to the guard bar 113 when the retainer 600 is mounted to the cartridge 100. It is foreseen that the retainer 600 could be designed so that the rear edge 619 is most adjacent to the guard bar 113 and the front edge 621 is most adjacent to the cap 115 without deviating from the scope of the present inventive concept. In this embodiment, the edges 619, 621 of the retainer 600 are coplanar side surfaces of the portions 601, 603, 605. Also, in this embodiment, similar to the retainer 500, the retainer 600 does not include a positioner. Similar to the retainers 200, 300, 400, 500, the retainer 600 includes a plurality of recesses 629 and a plurality of protrusions 631, which are formed on the surfaces 615, 617 of the retainer 600, respectively, and cooperatively operable to further secure the retainer 600 to the shaving cartridge 100 when the retainer 600 is mounted to the cartridge 100. Similar to the retainers 400, 500, the upper end portion 601 of the retainer 600 also includes a surface pattern without any ridges or depressions. The surface pattern of the upper end portion 601 of the retainer 600 is substantially planar and has a planar portion 637. In this manner, the planar portion 637 is operable to abut, position, and retain each of the blades 117 in the shaving cartridge 100, when the retainer 600 is mounted to the cartridge 100. The surface pattern formed in the upper end surface 601 of the retainer 600 results in the tip 611 having substantially planar upper and lower surfaces.

Relative to the retainers 200, 300, 400, the reduced sizes of the intermediate portions 605 and the lower end portions 603 of the legs 602 advantageously provide increased resilience of the legs 602, which facilitates assembly of the shaving cartridge 100 using the retainer 600. Likewise, the reduced sizes of the intermediate portions 605 and the lower end portions 603 partially define an aperture 671, which advantageously provides increased exposure of, and access to, the pair of side edges 105 while reducing material consumption and manufacturing costs. For instance, it is foreseen that the increased exposure of the side edges 105 could allow a user to view a component such as a visual usage indicator. It is also foreseen that at least a portion of the retainer 600 could be made of a transparent material to allow a user to view a component such as a visual usage indicator without deviating from the scope of the present inventive concept. The component may be positioned on one or both of the side edges 105 and adjacent to the blades 117. The component may be operable to communicate a status of the cartridge 100 to the user based on one or more other components of the cartridge 100, e.g., whether the cartridge 100 is new and functional, used and partially functional, and/or depleted and non-functional.

Figure 7B:
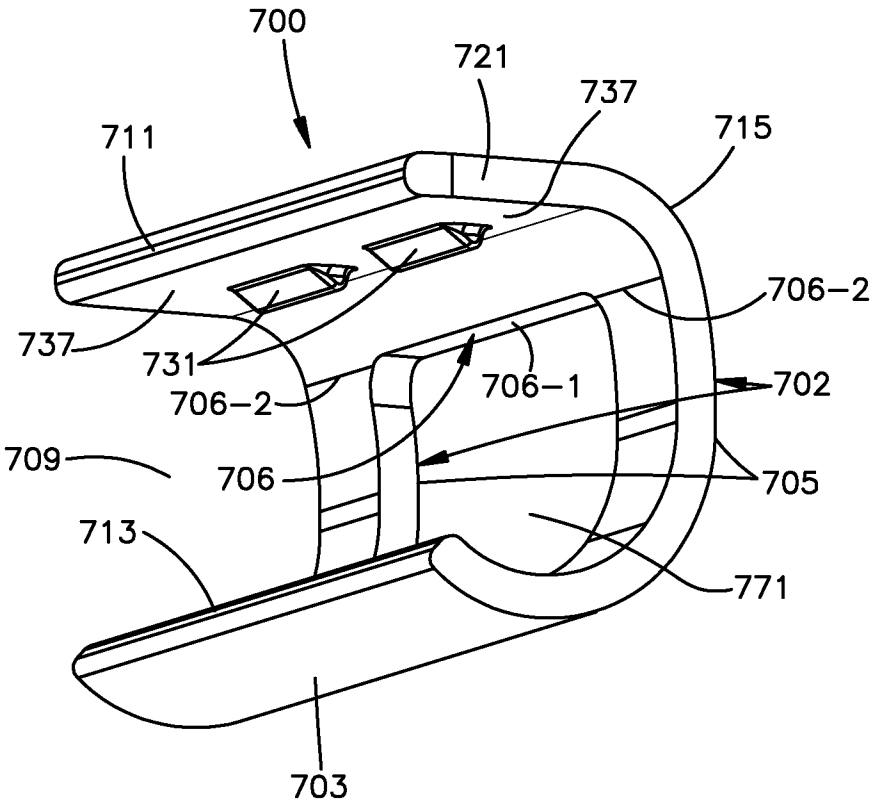
FIG. 7B is a diagram illustrating a bottom, rear perspective view of the retainer shown in FIG. 7A.
Figure 7A:
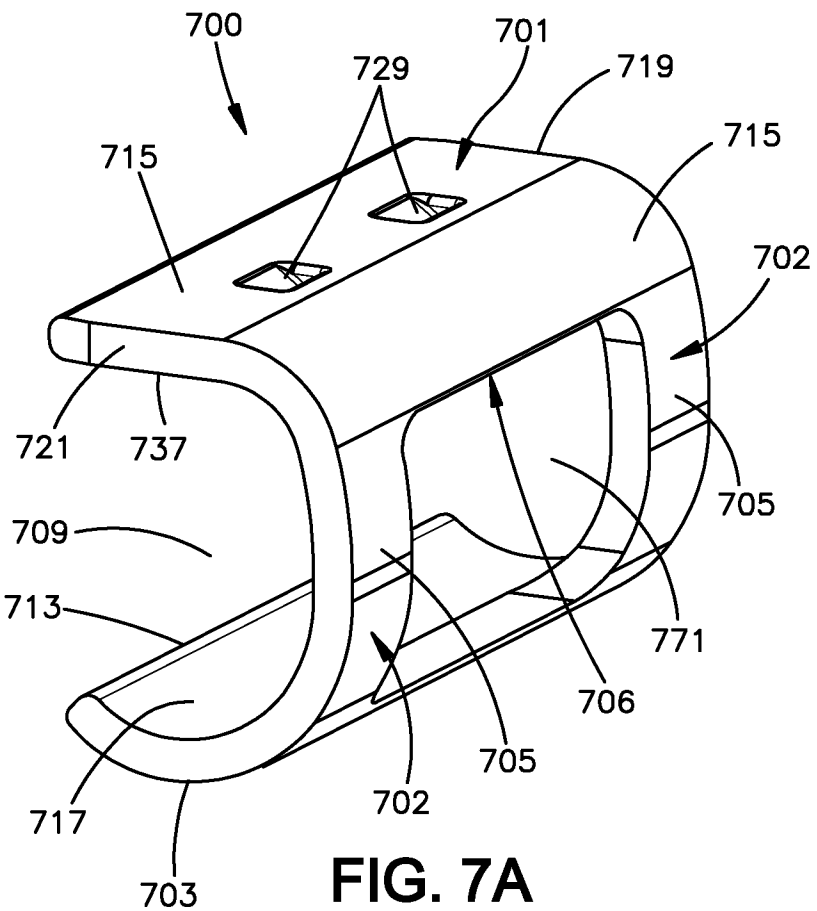
FIG. 7A is a diagram illustrating a top, front perspective view of another embodiment of the retainers shown in FIG. 1A.

Turning to FIGS. 7A and 7B, another embodiment of the present inventive concept is illustrated, with a retainer 700. Similar to the retainer 600, the retainer 700 includes an upper end portion 701 and a plurality of legs 702, but each of the legs 702 secures a common bottom or lower end portion 703 to the upper end portion 701 via middle or intermediate portions 705. Each of the legs 702 depend from only a portion of an edge 706 of the upper end portion 701. In this manner, the legs 702 cause an exposed portion 706-1 of the edge 706 to be exposed by the legs 702, and a concealed portion 706-2 of the edge 706 to be concealed by the legs 702. In the exemplary embodiment, each of the legs 702 is integrally formed with the upper end portion 701. It is foreseen, however, that one or both of the legs 702 could be manufactured separately from the upper end portion 701 and secured thereto during manufacturing of the retainer 700, e.g., via welding, glue, or other attachment means, without deviating from the scope of the present inventive concept. The upper end portion 701, the lower end portion 703, and the intermediate portions 705 collectively define a cavity 709, which is operable to securely receive the portion of the side edge 105 therein. The retainer 700 includes a first face, or tip 711, on the upper end portion 701 and a second face, or tip 713, on the lower end portion 703 with each of the tips 711, 713 generally facing toward the blades 117 when the retainer 700 is mounted to the cartridge 100. The tips 711, 713 are substantially rounded, each with a curvature defined by a plurality of radii inclusive of, about, and/or between 0.1 millimeters and 0.25 millimeters, and preferably inclusive of, about, and/or between 0.15 millimeters and 0.2 millimeters. It is foreseen that either or both of the tips 711, 713 may be rounded, planar, or a combination thereof without deviating from the scope of the present inventive concept. An outer surface 715 of the retainer 700 extends entirely between the tips 711, 713 and along the portions 701, 703, 705. On an opposite side of the retainer 700, an inner surface 717 extends entirely between the tips 711, 713 and along the portions 701, 703, 705 to directly abut and substantially surround a portion of the side edge 105 of the housing of the cartridge 100 when the retainer 700 is mounted to the cartridge 100. The upper end surface 701 of the retainer 700 includes a rear edge 719 that is adjacent to the cap 115 and a front edge 721 that is adjacent to the guard bar 113 when the retainer 700 is mounted to the cartridge 100. It is foreseen that the retainer 700 could be designed so that the rear edge 719 is most adjacent to the guard bar 113 and the front edge 721 is most adjacent to the cap 115 without deviating from the scope of the present inventive concept. In this embodiment, the edges 719, 721 of the retainer 700 are coplanar side surfaces of the portions 701, 703, 705. Also, in this embodiment, similar to the retainers 500, 600, the retainer 700 does not include a positioner. Similar to the retainers 200, 300, 400, 500, 600, the retainer 700 includes a plurality of recesses 729 and a plurality of protrusions 731, which are formed on the surfaces 715, 717 of the retainer 700, respectively, and cooperatively operable to further secure the retainer 700 to the shaving cartridge 100 when the retainer 700 is mounted to the cartridge 100. Similar to the retainers 400, 500, 600, the upper end portion 701 of the retainer 700 also includes a surface pattern without any ridges or depressions. The surface pattern of the upper end portion 701 of the retainer 700 is substantially planar and has a planar portion 737. In this manner, the planar portion 737 is operable to abut, position, and retain each of the blades 117 in the shaving cartridge 100 when the retainer 700 is mounted to the cartridge 100. The surface pattern formed in the upper end surface 701 of the retainer 700 results in the tip 711 having substantially planar upper and lower surfaces. Relative to the retainers 200, 300, 400, the reduced sizes of the intermediate portions 705 of the legs 702 advantageously provide increased resilience of the legs 702, which facilitates assembly of the shaving cartridge 100 using the retainer 700. Likewise, the reduced sizes of the intermediate portions 705 partially define an aperture 771, which advantageously provides increased exposure of, and access to, the pair of side edges 105 while reducing material consumption and manufacturing costs. For instance, it is foreseen that the increased exposure of the side edges 105 could allow a user to view a component such as a visual usage indicator. It is also foreseen that at least a portion of the retainer 700 could be made of a transparent material to allow a user to view a component such as a visual usage indicator without deviating from the scope of the present inventive concept. The component may be positioned on one or both of the side edges 105 and adjacent to the blades 117. The component may be operable to communicate a status of the cartridge 100 to the user based on one or more other components of the cartridge 100, e.g., whether the cartridge 100 is new and functional, used and partially functional, and/or depleted and non-functional.

Figure 8B:
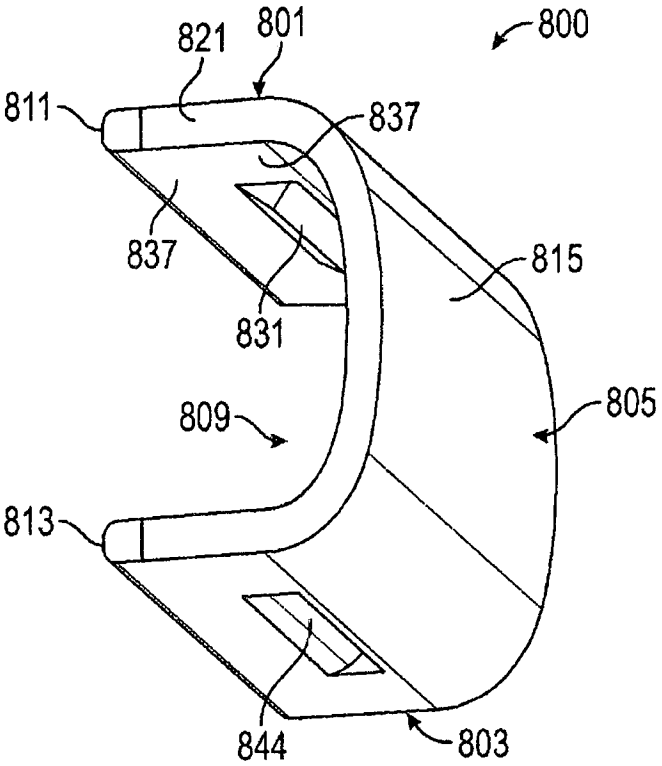
FIG. 8B is a diagram illustrating a bottom, rear perspective view of the retainer shown in FIG. 8A.
Figure 8A:
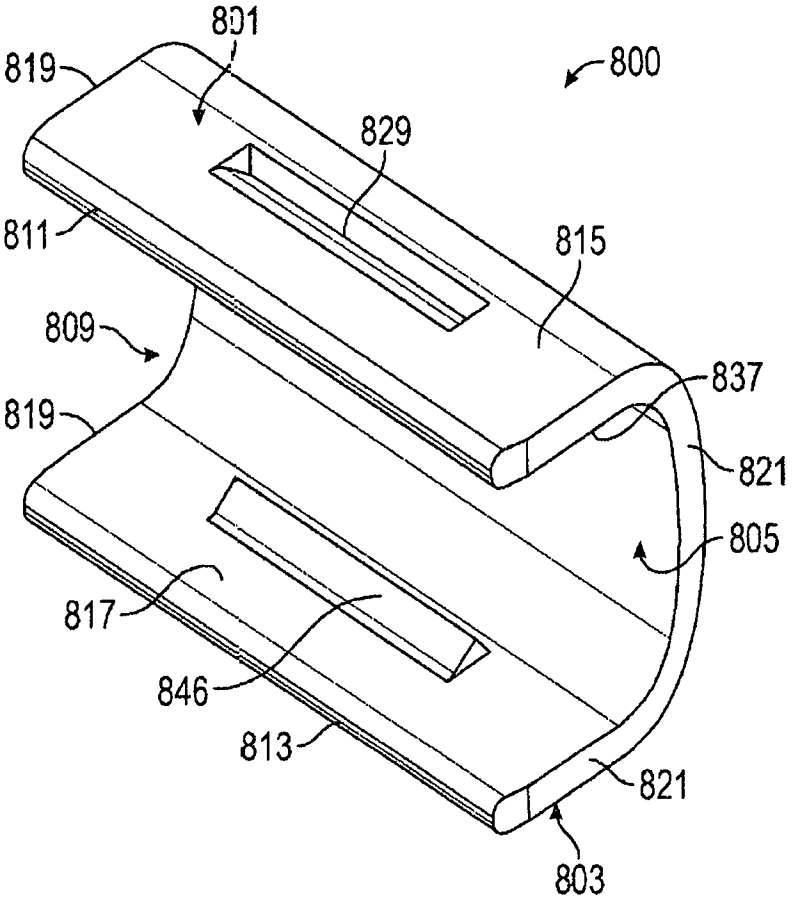
FIG. 8A is a diagram illustrating a top, front perspective view of another embodiment of the retainers shown in FIG. 1A.

Turning to FIGS. 8A and 8B, another embodiment of the present inventive concept is illustrated with a retainer 800. Similar to the retainers 200, 300, 400, the retainer 800 includes an upper end portion 801, a bottom or lower end portion 803, and a middle or intermediate portion 805, which connects the upper end portion 801 to the lower end portion 803. The upper end portion 801, the lower end portion 803, and the intermediate portion 805 collectively define a cavity 809, which is operable to securely receive the portion of the side edge 105 therein. The retainer 800 includes a first face, or tip 811, on the upper end portion 801 and a second face, or tip 813, on the lower end portion 803, with each of the tips 811, 813 generally facing toward the blades 117, when the retainer 800 is mounted to the cartridge 100. The tips 811, 813 are substantially rounded, each with a curvature defined by a plurality of radii inclusive of, about, and/or between 0.1 millimeters and 0.25 millimeters, and preferably about 0.2 millimeters. It is foreseen that either or both of the tips 811, 813 may be rounded, planar, or a combination thereof without deviating from the scope of the present inventive concept. An outer surface 815 of the retainer 800 extends entirely between the tips 811, 813 and along the portions 801, 803, 805. On an opposite side of the retainer 800, an inner surface 817 extends entirely between the tips 811, 813 and along the portions 801, 803, 805 to directly abut and substantially surround a portion of the side edge 105 of the housing of the cartridge 100 when the retainer 800 is mounted to the cartridge 100. The retainer 800 includes a rear edge 819 that is adjacent to the cap 115 and a front edge 821 that is adjacent to the guard bar 113 when the retainer 800 is mounted to the cartridge 100. It is foreseen that the retainer 800 could be designed so that the rear edge 819 is most adjacent to the guard bar 113 and the front edge 821 is most adjacent to the cap 115 without deviating from the scope of the present inventive concept. In this embodiment, the edges 819, 821 of the retainer 800 are coplanar side surfaces of the portions 801, 803, 805. Also, in this embodiment, similar to the retainers 500, 600, 700, the retainer 800 does not include a positioner. Similar to the retainers 200, 300, 400, 500, 600, 700, the retainer 800 includes an upper recess 829 and an upper protrusion 831, which are formed on the surfaces 815, 817 of the upper end portion 801 of the retainer 800, respectively, and cooperatively operable to further secure the retainer 800 to the shaving cartridge 100. Unlike the retainers 200, 300, 400, 500, 600, 700, the retainer 800 also includes a lower recess 844 and a lower protrusion 846, which are formed on the surfaces 815, 817 of the lower end portion 803 of the retainer 800, respectively, and cooperatively operable to further secure the retainer 800 to the shaving cartridge 100 in coordination with the upper recess 829 and the upper protrusion 831. In the exemplary embodiment, the size and shape of the upper recess 829 and the upper protrusion 831 are equal to the size and shape of the lower recess 844 and the lower protrusion 846, respectively. It is foreseen, however, that the sizes and/or shapes of the recesses 829, 844 and/or the protrusions 831, 846 could differ without deviating from the scope of the present inventive concept. Similar to the retainers 400, 500, 600, 700, the upper end portion 801 of the retainer 800 also includes a surface pattern, without any ridges or depressions. The surface pattern of the upper end portion 801 of the retainer 800 is substantially planar and has a planar portion 837. In this manner, the planar portion 837 is operable to abut, position, and retain each of the blades 117 in the shaving cartridge 100 when the retainer 800 is mounted to the cartridge 100. The surface pattern formed in the upper end surface 801 of the retainer 800 results in the tip 811 having substantially planar upper and lower surfaces.

Figure 9B:
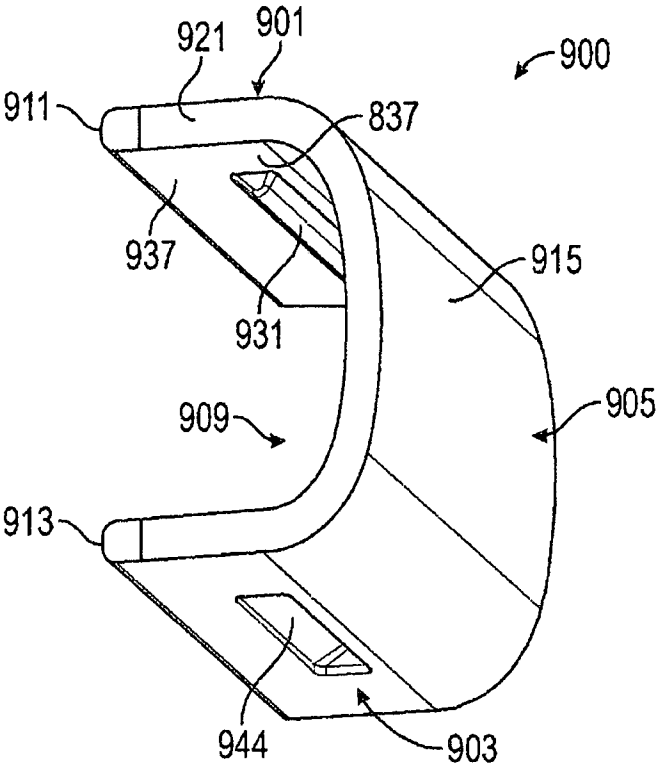
FIG. 9B is a diagram illustrating a bottom, rear perspective view of the retainer shown in FIG. 9A.
Figure 9A:
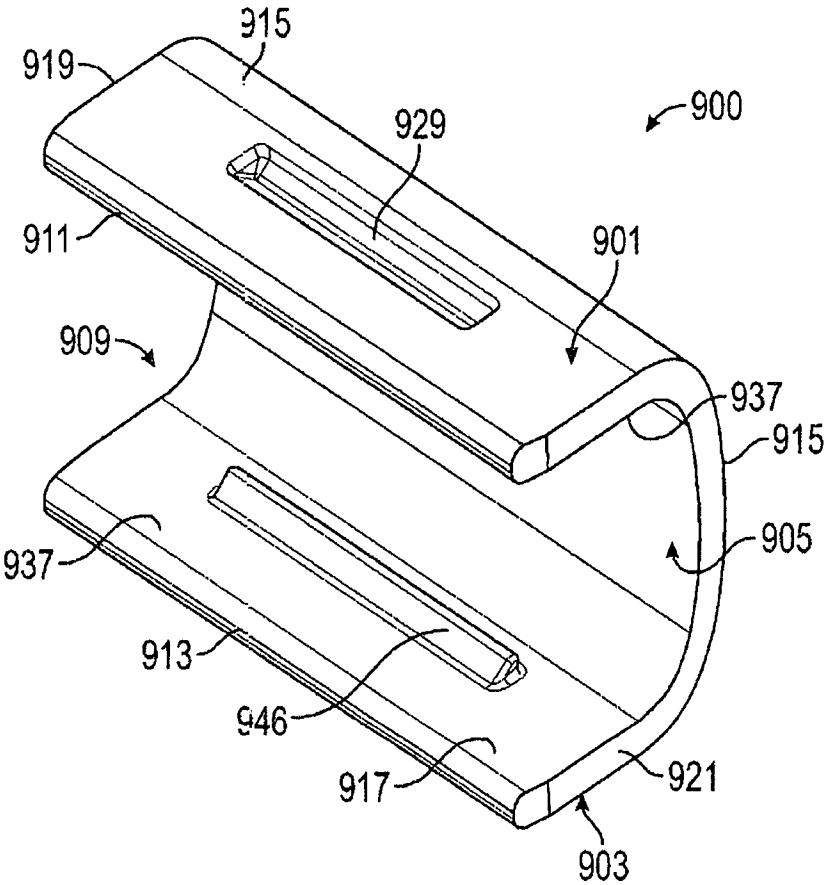
FIG. 9A is a diagram illustrating a top, front perspective view of another embodiment of the retainers shown in FIG. 1A.

Turning to FIGS. 9A and 9B, another embodiment of the present inventive concept is illustrated, with a retainer 900. Similar to the retainers 200, 300, 400, 800, the retainer 900 includes an upper end portion 901, a bottom or lower end portion 903, and a middle or intermediate portion 905, which connects the upper end portion 901 to the lower end portion 903. The upper end portion 901, the lower end portion 903, and the intermediate portion 905, collectively, define a cavity 909, which is operable to securely receive the portion of the side edge 105 therein. The retainer 900 includes a first face, or tip 911, on the upper end portion 901 and a second face, or tip 913, on the lower end portion 903, with each of the tips 911, 913 generally facing toward the blades 117, when the retainer 900 is mounted to the cartridge 100. The tips 911, 913 are substantially rounded, each with a curvature defined by a plurality of radii inclusive of, about, and/or between 0.1 millimeters and 0.25 millimeters, and preferably about 0.2 millimeters. It is foreseen that either or both of the tips 911, 913 may be rounded, planar, or a combination thereof without deviating from the scope of the present inventive concept. An outer surface 915 of the retainer 900 extends entirely between the tips 911, 913 and along the portions 901, 903, 905. On an opposite side of the retainer 900, an inner surface 917 extends entirely between the tips 911, 913 and along the portions 901, 903, 905 to directly abut and substantially surround a portion of the side edge 105 of the housing of the cartridge 100 when the retainer 900 is mounted to the cartridge 100. The retainer 900 includes a rear edge 919 that is adjacent to the cap 115 and a front edge 921 that is adjacent to the guard bar 113 when the retainer 900 is mounted to the cartridge 100. It is foreseen that the retainer 900 could be designed so that the rear edge 919 is most adjacent to the guard bar 113 and the front edge 921 is most adjacent to the cap 115 without deviating from the scope of the present inventive concept. In this embodiment, the edges 919, 921 of the retainer 900 are coplanar side surfaces of the portions 901, 903, 905. Also, in this embodiment, similar to the retainers 500, 600, 700, 800, the retainer 900 does not include a positioner. Similar to the retainers 200, 300, 400, 500, 600, 700, 800, the retainer 900 includes an upper recess 929 and an upper protrusion 931, which are formed on the surfaces 915, 917 of the upper end portion 901 of the retainer 900, respectively, and cooperatively operable to further secure the retainer 900 to the shaving cartridge 100. Similar to the retainer 800, the retainer 900 includes a lower recess 944 and a lower protrusion 946, which are formed on the surfaces 915, 917 of the lower end portion 903 of the retainer 900, respectively, and cooperatively operable to further secure the retainer 900 to the shaving cartridge 100 in coordination with the upper recess 929 and the upper protrusion 931. In the exemplary embodiment, the size and shape of the upper recess 929 and the upper protrusion 931 are equal to the size and shape of the lower recess 944 and the lower protrusion 946, respectively. It is foreseen, however, that the sizes and/or shapes of the recesses 929, 944 and/or the protrusions 931, 946 could differ without deviating from the scope of the present inventive concept. Similar to the retainers 400, 500, 600, 700, 800, the upper end portion 901 of the retainer 900 also includes a surface pattern without any ridges or depressions. The surface pattern of the upper end portion 901 of the retainer 900 is substantially planar and has a planar portion 937. In this manner, the planar portion 937 is operable to abut, position, and retain each of the blades 117 in the shaving cartridge 100 when the retainer 900 is mounted to the cartridge 100. The surface pattern formed in the upper end surface 901 of the retainer 900 results in the tip 911 having substantially planar upper and lower surfaces.

Figure 10B:
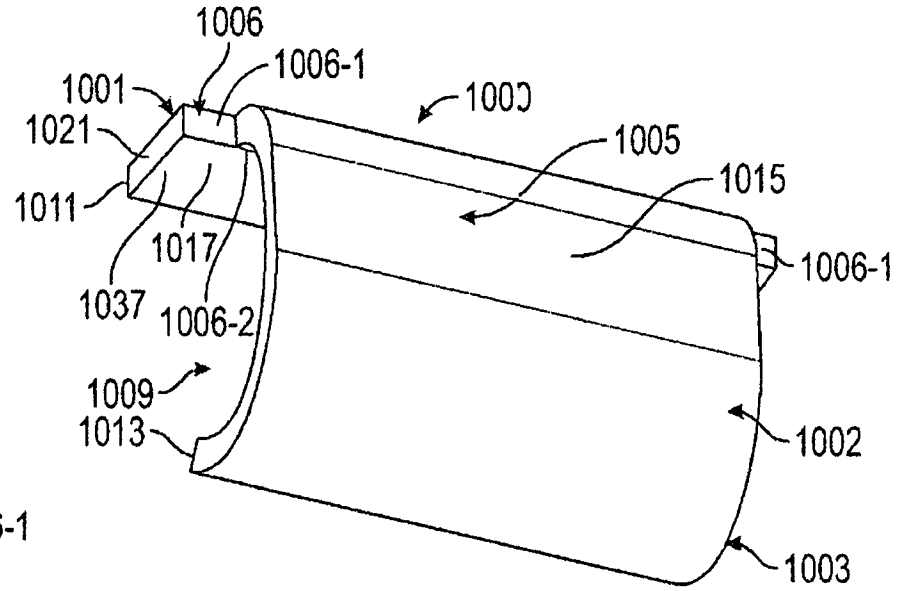
FIG. 10B is a diagram illustrating a bottom, rear perspective view of the retainer shown in FIG. 10A.
Figure 10A:
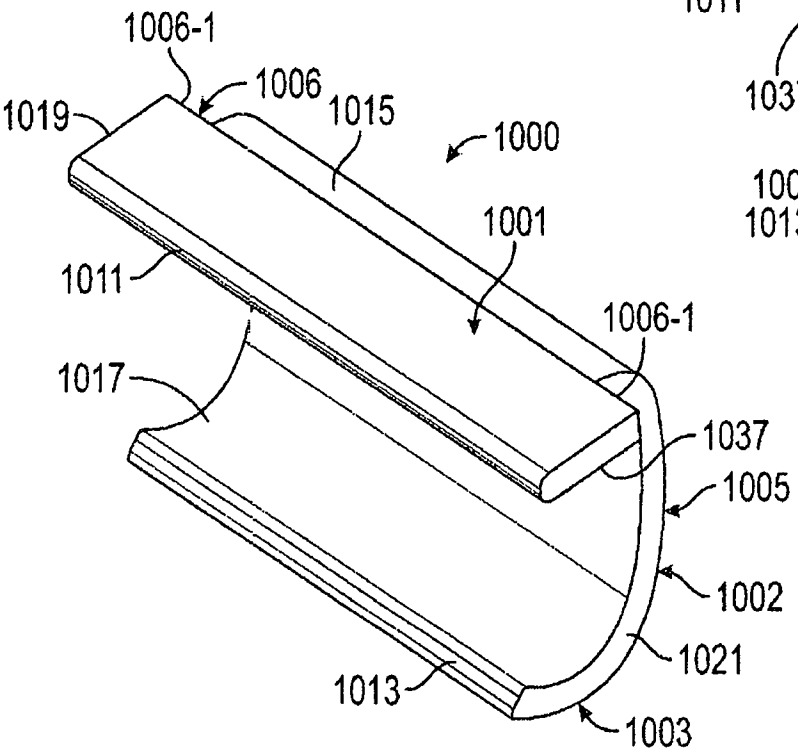
FIG. 10A is a diagram illustrating a top, front perspective view of another embodiment of the retainers shown in FIG. 1A.

Turning to FIGS. 10A and 10B, another embodiment of the present inventive concept is illustrated with a retainer 1000. Similar to the retainer 500, the retainer 1000 includes an upper end portion 1001, but includes a leg 1002 having a bottom or lower end portion 1003, and a middle or intermediate portion 1005. The leg 1002 depends from only a portion of an edge 1006 of the upper end portion 1001. In this manner, the leg 1002 causes an exposed portion 1006-1 of the edge 1006 to be exposed by the leg 1002, and a concealed portion 1006-2 of the edge 1006 to be concealed by the leg 1002. In the exemplary embodiment, the leg 1002 is integrally formed with the upper end portion 1001. It is foreseen, however, that the leg 1002 could be manufactured separately from the upper end portion 1001 and secured thereto during manufacturing of the retainer 1000, e.g., via welding, glue, or other attachment means, without deviating from the scope of the present inventive concept. The intermediate portion 1005 connects the upper end portion 1001 to the lower end portion 1003. The upper end portion 1001, the lower end portion 1003, and the intermediate portion 1005 collectively define a cavity 1009, which is operable to securely receive the portion of the side edge 105 therein. The retainer 1000 includes a first face, or tip 1011, on the upper end portion 1001 and a second face, or tip 1013, on the lower end portion 1003, with each of the tips 1011, 1013 generally facing toward the blades 117, when the retainer 1000 is mounted to the cartridge 100. The tips 1011, 1013 are substantially rounded, each with a curvature defined by a plurality of radii inclusive of, about, and/or between 0.1 millimeters and 0.25 millimeters, and preferably inclusive of, about, and/or between 0.15 millimeters and 0.2 millimeters. It is foreseen that either or both of the tips 1011, 1013 may be rounded, planar, or a combination thereof, without deviating from the scope of the present inventive concept. An outer surface 1015 of the retainer 1000 extends entirely between the tips 1011, 1013 and along the portions 1001, 1003, 1005. On an opposite side of the retainer 1000, an inner surface 1017 extends entirely between the tips 1011, 1013 and along the portions 1001, 1003, 1005 to directly abut and substantially surround a portion of the side edge 105 of the housing of the cartridge 100 when the retainer 1000 is mounted to the cartridge 100. The upper end surface 1001 of the retainer 1000 includes a rear edge 1019 that is adjacent to the cap 115 and a front edge 1021 that is adjacent to the guard bar 113 when the retainer 1000 is mounted to the cartridge 100. It is foreseen that the retainer 1000 could be designed so that the rear edge 1019 is most adjacent to the guard bar 113 and the front edge 1021 is most adjacent to the cap 115 without deviating from the scope of the present inventive concept. In this embodiment, edges 1019, 1021 of the upper end surface 1001 of the retainer 1000 are not coplanar to side surfaces of the portions 1003, 1005. Also, in this embodiment, similar to the retainer 500, the retainer 1000 does not include a positioner. Unlike the retainers 200, 300, 400, 500, the retainer 1000 does not include any recesses or any protrusions. Similar to the retainers 400, 500, 600, 700, 800, 900, the upper end portion 1001 of the retainer 1000 also includes a surface pattern without any ridges or depressions. The surface pattern of the upper end portion 1001 of the retainer 1000 is substantially planar and has a planar portion 1037. In this manner, the planar portion 1037 is operable to abut, position, and retain each of the blades 117 in the shaving cartridge 100, when the retainer 1000 is mounted to the cartridge 100. The surface pattern formed in the upper end surface 1001 of the retainer 1000 results in the tip 1011 having substantially planar upper and lower surfaces. Similar to the retainer 500, the reduced sizes of the intermediate portion 1005 and the lower end portion 1003 of the leg 1002 advantageously provide increased resilience of the leg 1002, which facilitates assembly of the shaving cartridge 100 using the retainer 1000. Likewise, the reduced sizes of the intermediate portion 1005 and the lower end portion 1003 advantageously provide increased exposure of and access to the pair of side edges 105 while reducing material consumption and manufacturing costs. For instance, it is foreseen that the increased exposure of the side edges 105 could allow a user to view a component such as a visual usage indicator. It is also foreseen that at least a portion of the retainer 1000 could be made of a transparent material to allow a user to view a component such as a visual usage indicator without deviating from the scope of the present inventive concept. The component may be positioned on one or both of the side edges 105 and adjacent to the blades 117. The component may be operable to communicate a status of the cartridge 100 to the user based on one or more other components of the cartridge 100, e.g., whether the cartridge 100 is new and functional, used and partially functional, and/or depleted and non-functional.

Figure 11B:
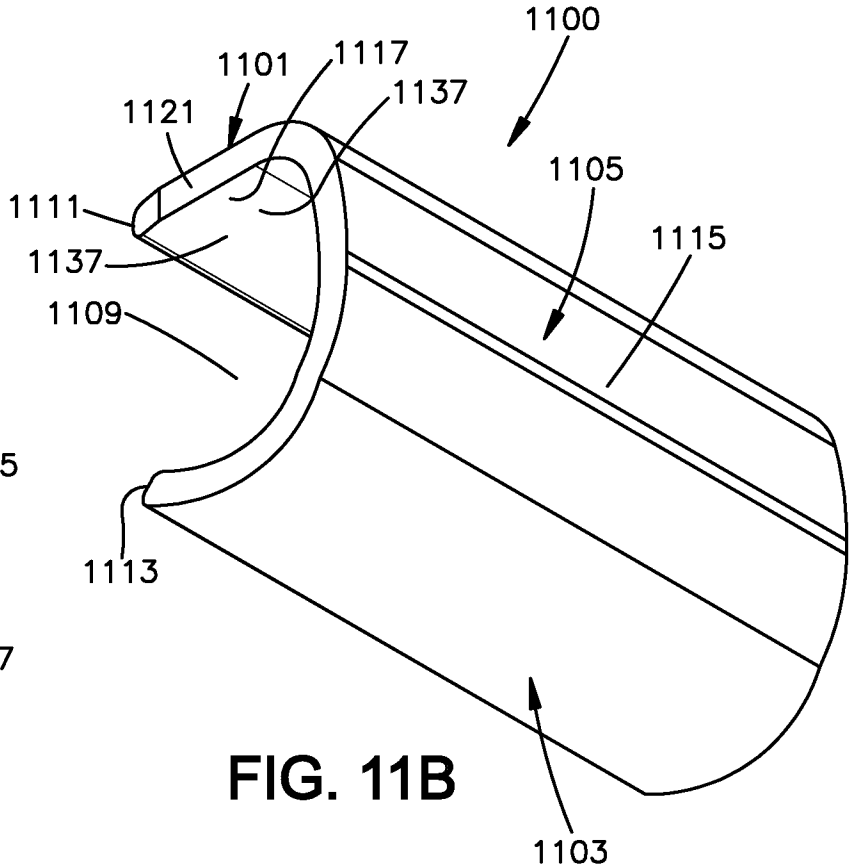
FIG. 11B is a diagram illustrating a bottom, rear perspective view of the retainer shown in FIG. 11A.
Figure 11A:
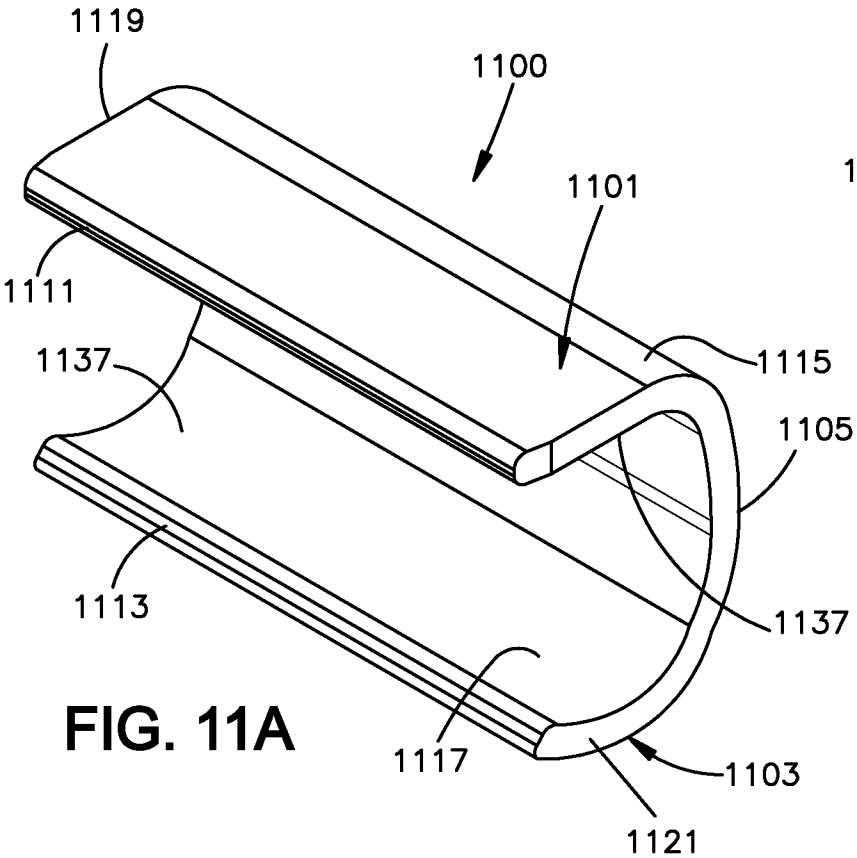
FIG. 11A is a diagram illustrating a top, front perspective view of another embodiment of the retainers shown in FIG. 1A.
Figure 12:
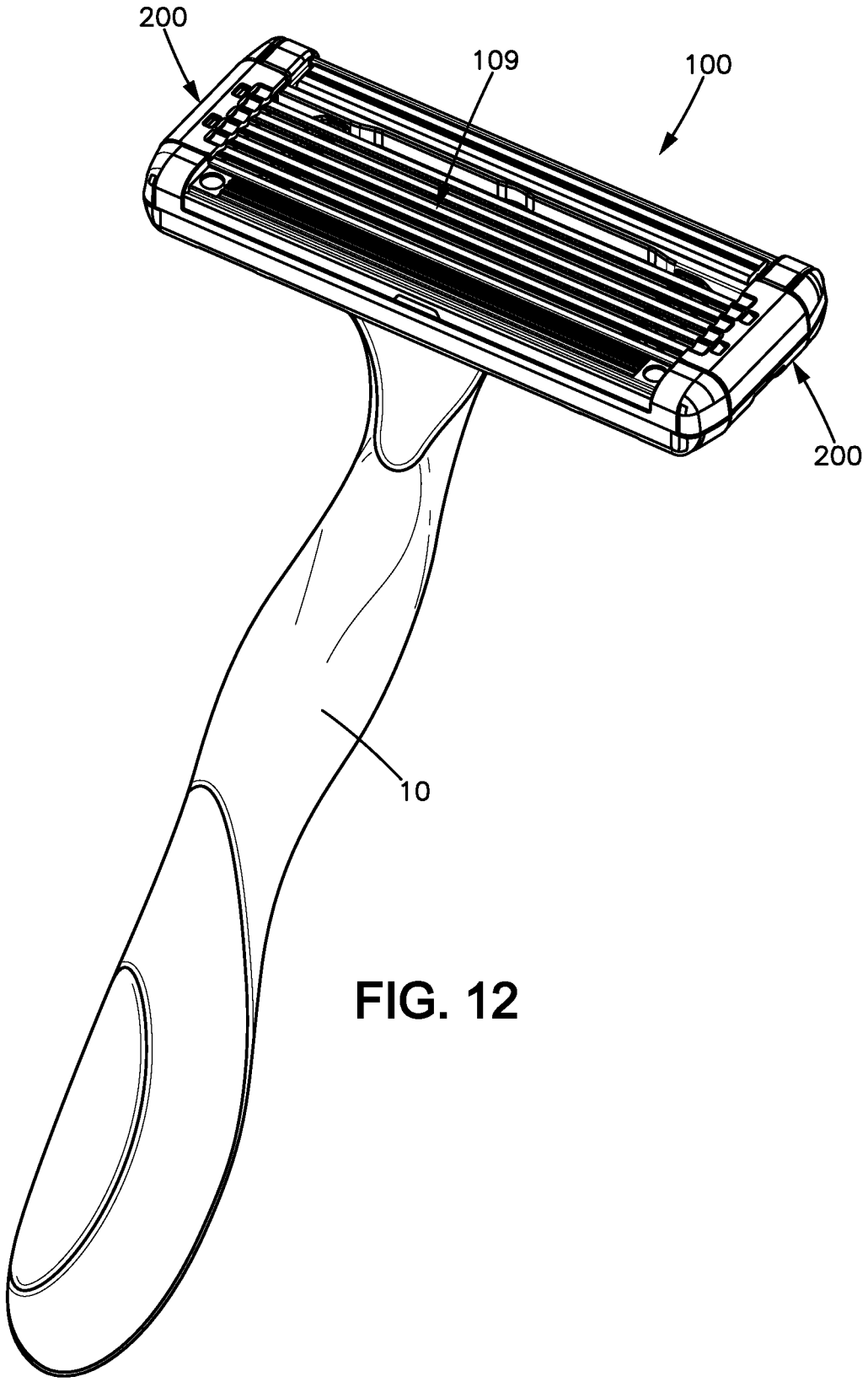
FIG. 12 is a diagram illustrating a perspective view of a shaving cartridge with retainers secured to a handle.

Turning to FIGS. 11A and 11B, another embodiment of the present inventive concept is illustrated with a retainer 1100. Similar to the retainers 200, 300, 400, 800, 900, the retainer 1100 includes an upper end portion 1101, a bottom or lower end portion 1103, and a middle or intermediate portion 1105, which connects the upper end portion 1101 to the lower end portion 1103. The upper end portion 1101, the lower end portion 1103, and the intermediate portion 1105 collectively define a cavity 1109, which is operable to securely receive the portion of the side edge 105 therein. The retainer 1100 includes a first face, or tip 1111, on the upper end portion 1101 and a second face, or tip 1113, on the lower end portion 1103, with each of the tips 1111, 1113 generally facing toward the blades 117, when the retainer 1100 is mounted to the cartridge 100. The tips 1111, 1113 are substantially rounded, each with a curvature defined by a plurality of radii inclusive of, about, and/or between 0.1 millimeters and 0.25 millimeters, and preferably inclusive of, about, and/or between 0.15 millimeters and 0.2 millimeters. It is foreseen that either or both of the tips 1111, 1113 may be rounded, planar, or a combination thereof without deviating from the scope of the present inventive concept. An outer surface 1115 of the retainer 1100 extends entirely between the tips 1111, 1113 and along the portions 1101, 1103, 1105. On an opposite side of the retainer 1100, an inner surface 1117 extends entirely between the tips 1111, 1113 and along the portions 1101, 1103, 1105 to directly abut and substantially surround a portion of the side edge 105 of the housing of the cartridge 100 when the retainer 1100 is mounted to the cartridge 100. The retainer 1100 includes a rear edge 1119 that is adjacent to the cap 115 and a front edge 1121 that is adjacent to the guard bar 113 when the retainer 1100 is mounted to the cartridge 100. It is foreseen that the retainer 1100 could be designed so that the rear edge 1119 is most adjacent to the guard bar 113 and the front edge 1121 is most adjacent to the cap 115 without deviating from the scope of the present inventive concept. In this embodiment, the edges 1119, 1121 of the retainer 1100 are coplanar side surfaces of the portions 1101, 1103, 1105. Also, in this embodiment, similar to the retainers 500, 600, 700, 800, 900, the retainer 1100 does not include a positioner. Also, similar to the retainer 1000, the retainer 1100 does not include any recesses or any protrusions. Similar to the retainers 400, 500, 600, 700, 800, 900, 1000, the upper end portion 1101 of the retainer 1100 includes a surface pattern without any ridges or depressions. The surface pattern of the upper end portion 1101 of the retainer 1100 is substantially planar and has a planar portion 1137. In this manner, the planar portion 1137 is operable to abut, position, and retain each of the blades 117 in the shaving cartridge 100 when the retainer 1100 is mounted to the cartridge 100. The surface pattern formed in the upper end surface 1101 of the retainer 1100 results in the tip 1111 having substantially planar upper and lower surfaces.

It will be appreciated by those skilled in the art that changes could be made to the embodiments described above without departing from the broad inventive concept thereof. It is understood, therefore, that the present inventive concept disclosed herein is not limited to the particular embodiments disclosed, and is intended to cover modifications within the spirit and scope of the present inventive concept.

One of skill in the art will recognize that the described examples are not limited to any particular size. Further, one of skill in the art will recognize that the components of the retainer 200 are not limited to any type of material. In a preferred example, the retainer, e.g., any one or more of the retainers 200, 300, 400, 500, 600, 700, 800, 900, 1000, 1100, is formed of a metal material, but may be formed of a variety of different materials including plastic or the like, or a combination thereof. One skilled in the art will recognize that different diameters, types, and thicknesses of preferred materials can be utilized when taking into consideration design and stability considerations. A number of manufacturing techniques may be used such as the machining, molding, or casting one or more components of the retainer. An example process of manufacturing the retainer includes use of a punch and die metal-forming process to form various components of the retainer. For example, a plurality of protrusions, e.g., the plurality of protrusions 231, and a plurality of recesses, e.g., the plurality of recesses 229, may be formed via such a process, whereby a die shaped like the plurality of protrusions is oriented on an inner surface, e.g., the inner surface 217 of the retainer 200, with adequate offset needs for stamping. An outer surface, e.g., the outer surface 215, of an upper end portion, is punched, which results in simultaneous formation of the plurality of recesses on the outer surface and the plurality of protrusions on the inner surface due to a transfer of material of the retainer. Each of the protrusions is caused to extend from the inner surface of the upper end portion and assume the shape of the die. Other components that can be formed using a punch and die metal-forming process include a plurality of ridges, a plurality of depressions, and/or a positioner. For instance, a die shaped like the plurality of ridges 245 may be oriented on the inner surface 217 of the retainer 200 with adequate offset needs for stamping. The outer surface 215 of the upper end portion 201 is punched, which results in simultaneous formation of the plurality of depressions 259 on the outer surface 215 and the plurality of ridges 245 on the inner surface 217 due to a transfer of material of the retainer 200. The plurality of ridges 245 is caused to extend from the inner surface 217 of the upper end portion 201 and assume the shape of the die. Use of a punch and die metal-forming process to form various components advantageously provides for high-volume replication with high precision and accuracy in positioning the various components on the retainer and ultimately with respect to the blades 117. Alternatively, if other materials are used to form the retainer, e.g., plastic, the various components of the retainer can be produced via an injection molding process or other like manufacturing means.

It will be appreciated by those skilled in the art that changes could be made to the embodiments described above without departing from the broad inventive concept thereof. It is understood, therefore, that the present invention disclosed herein is not limited to the particular embodiments disclosed, and is intended to cover modifications within the spirit and scope of the present invention.

What is claimed is:

1. A retainer operable to secure a plurality of blades in a shaving blade unit, the retainer comprising:

an upper portion and a lower portion connected via an intermediate portion, the upper portion extending along a first axis and the lower portion extending along a second axis, the first and second axes of the upper portion and the lower portion being parallel to each other, the upper portion extending between a first upper edge and a second upper edge, and the lower portion extending between a first lower edge and a second lower edge, the intermediate portion extending along an intermediate axis perpendicular to the first and second axes of the upper and lower portions;

the upper portion including an inner face and an outer face, a distance between the inner face and the outer face defining a thickness of the upper portion, the thickness extending between the first and second upper edges of the upper portion;

a portion of the outer face of the upper portion including a plurality of depressions, the plurality of depressions extending away from the outer face toward the inner face of the upper portion, and extending into the thickness of the upper portion a predetermined depth to form a first surface pattern;

a portion of the inner face of the upper portion including a plurality of ridges, the plurality of ridges extending away from the inner face of the upper portion toward the lower portion to form a second surface pattern spaced from and corresponding to the first surface pattern, at least two sides of each of the plurality of ridges extending from and connected to the inner face of the upper portion such that the plurality of ridges provides stiffness to the upper portion;

each one of the plurality of ridges defining a blade-abutment surface, and another portion of the inner face of the upper portion including a planar surface defining a plurality of additional blade abutment surfaces; and each one of the plurality of ridges abuts only a respective one of the plurality of blades.

2. The retainer of claim 1, wherein the upper portion further includes a protrusion, the protrusion extending away from the inner face of the upper portion towards the lower portion and is positioned between the plurality of ridges and the intermediate portion.

3. The retainer of claim 2, wherein another portion of the inner face includes a planar surface, and wherein the protrusion extends from the planar surface of the upper portion to a tip, the protrusion being defined by (i) a backstop surface on a side of the protrusion and the backstop surface extending perpendicular to the planar surface of the upper portion, and (ii) an angled surface on another side of the protrusion extending between the tip of the protrusion and the planar surface of the upper portion.

4. The retainer of claim 1, wherein, the upper portion further includes a recess, the recess extending away from the outer face of the upper portion and toward the inner face of the upper portion, the recess thereby forming a protrusion extending from the inner face of the upper portion.

5. The retainer of claim wherein, the inner face of the upper portion is operable to abuttingly engage a surface of each blade of a shaving blade unit, respectively, at (i) of the blade-abutment surfaces of the plurality of ridges, and (ii) one of the additional blade abutment surfaces of the planar surface.

6. The retainer of claim 1, wherein, each of the plurality of additional blade abutment surfaces and each of the blade-abutment surfaces are capable of cooperatively securing one blade of a shaving blade unit.

7. The retainer of claim 1, wherein, each of the plurality of ridges include a tip that is offset to one side of each of the plurality of ridges.

* * * * *